US008152539B2

(12) United States Patent
Moriyama et al.

(10) Patent No.: US 8,152,539 B2
(45) Date of Patent: Apr. 10, 2012

(54) CONNECTOR UNIT FOR DIFFERENTIAL TRANSMISSION

(75) Inventors: Satoshi Moriyama, Shinagawa (JP); Tadashi Kumamoto, Shinagawa (JP); Masahiro Hamazaki, Shinagawa (JP); Mitsuru Kobayashi, Shinagawa (JP); Kiyoshi Sato, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/346,951

(22) Filed: Dec. 31, 2008

(65) Prior Publication Data

US 2009/0124134 A1 May 14, 2009

Related U.S. Application Data

(62) Division of application No. 11/118,313, filed on May 2, 2005, now Pat. No. 7,488,188.

(30) Foreign Application Priority Data

Jul. 26, 2004 (JP) ..... 2004-217294

Mar. 1, 2005 (JP) ..... 2005-056320

(51) Int. Cl.
*H01R 4/66* (2006.01)
*H01R 13/648* (2006.01)

(52) U.S. Cl. ..... 439/108; 439/862

(58) Field of Classification Search ..... 439/101, 439/108, 862

See application file for complete search history.

(56) References Cited

U.S. PATENT DOCUMENTS

| | | | | |
|---|---|---|---|---|
| 4,045,868 | A | 9/1977 | Ammon et al. | |
| 4,274,699 | A * | 6/1981 | Keim | 439/637 |
| 4,846,727 | A | 7/1989 | Glover et al. | |
| 4,867,690 | A * | 9/1989 | Thumma | 439/79 |
| 5,046,960 | A | 9/1991 | Fedder | |
| 5,169,324 | A * | 12/1992 | Lemke et al. | 439/101 |
| 5,238,414 | A * | 8/1993 | Yaegashi et al. | 439/108 |
| 6,328,602 | B1 | 12/2001 | Yamasaki et al. | |
| 6,368,121 | B1 | 4/2002 | Ueno et al. | |

FOREIGN PATENT DOCUMENTS

JP 4-294076 10/1992

(Continued)

OTHER PUBLICATIONS

Communication from the Japanese Patent Office mailed on Feb. 9, 2010 in the related Japanese patent application No. 2005-056320.

(Continued)

*Primary Examiner* — Felix O Figueroa
(74) *Attorney, Agent, or Firm* — Staas & Halsey LLP

(57) ABSTRACT

A differential transmission connector unit is disclosed that includes a first differential transmission connector including a first electrically insulating block body; and first signal contact pairs and first ground contacts arranged alternately in a row in the first block body; and a second differential transmission connector including a second electrically insulating block body; and second signal contact pairs and second ground contacts arranged alternately in a row in the second block body. The first differential transmission connector is connected to the second differential transmission connector with the first signal contact pairs and the second signal contact pairs being in contact with each other and the first ground contacts and the second ground contacts being in contact with each other. One of the contact surface of each first ground contact and the contact surface of the corresponding second ground contact is a rolled surface, the contact surfaces contacting each other.

6 Claims, 28 Drawing Sheets

FOREIGN PATENT DOCUMENTS

| | | |
|---|---|---|
| JP | 2000-68006 | 3/2000 |
| JP | 2001-6820 | 1/2001 |

OTHER PUBLICATIONS

Office communication mailed from the United States Patent and Trademark Office on Mar. 24, 2006 in the related U.S. Appl. No. 11/118,313.

Office communication mailed from the United States Patent and Trademark Office on Sep. 6, 2006 in the related U.S. Appl. No. 11/118,313.

Office communication mailed from the United States Patent and Trademark Office on Feb. 20, 2007 in the related U.S. Appl. No. 11/118,313.

Office communication mailed from the United States Patent and Trademark Office on Aug. 2, 2007 in the related U.S. Appl. No. 11/118,313.

Office communication mailed from the United States Patent and Trademark Office on Jan. 3, 2008 in the related U.S. Appl. No. 11/118,313.

Office communication mailed from the United States Patent and Trademark Office on Jun. 26, 2008 in the related U.S. Appl. No. 11/118,313.

Office communication mailed from the United States Patent and Trademark Office on Nov. 3, 2008 in the related U.S. Appl. No. 11/118,313.

* cited by examiner 133
133a
271
133e
133d
270
202
133b 133a
133e
133d
202
203
133b
133c
133f 133a
271
133e
133d
270
203
133c 133d-1
133a
133d-2
α1
α2
133d-3

133a

CONNECTOR UNIT FOR DIFFERENTIAL TRANSMISSION

CROSS-REFERENCE TO RELATED APPLICATIONS

This application is a divisional application of application Ser. No. 11/118,313 filed May 2, 2005, now U.S. Pat. No. 7,488,188 now allowed, and is based upon and claims the benefit of priority from Japanese Patent Applications No. 2004-217294, filed on Jul. 26, 2004, and No. 2005-056320, filed on Mar. 1, 2005, the entire contents of which are hereby incorporated by reference.

BACKGROUND OF THE INVENTION

1. Field of the Invention

The present invention relates to a connector unit for differential transmission.

2. Description of the Related Art

There are two types of data transmission methods: a normal transmission method and a differential transmission method. The normal transmission method employs an electric wire for each data item. The differential transmission method, using a pair of electric wires for each data item, simultaneously transmits a "+" signal to be transmitted and a "−" signal equal in magnitude and opposite in direction to the "+" signal. The differential transmission method, which has the advantage of being less susceptible to noise compared with the normal transmission method, has been used more widely.

A connector is used to transmit data between apparatuses. In order to form a data path for differential transmission between the apparatuses, a connector for differential transmission (a differential transmission connector) having a special structure is used. Compared with normal connectors, the differential transmission connector has a complicated structure. However, the differential transmission connector is required to have the same insertion and extraction durability as that of normal connectors. Here, the term "insertion and extraction durability" refers to the number of times a cable connector is inserted into (and connected to) and extracted from a socket connector which number can still guarantee stable differential transmission in the case of repeated insertion and extraction operations.

FIGS. 1 and 2 are schematic diagrams illustrating a conventional differential transmission connector unit 10. The differential transmission connector unit 10 includes a cable connector 20 at a cable end and a socket connector 30 to be mounted on a printed board. In FIGS. 1 and 2, X1-X2 represents the X-axial directions (the directions of the row of contact alignment or the directions of connector width), Z1-Z2 represents the Z-axial directions (the directions of the column of contact alignment or the directions of connector height, and Y1-Y2 represents the Y-axial directions (the directions of contact length, the directions of connector depth, or the directions of connector insertion and extraction). This representation of directions is equally applied to all drawings illustrating embodiments of the present invention. FIG. 1 illustrates a state where the contacts of the cable connector 20 and the contacts of the socket connector 30 oppose each other. FIG. 2 illustrates a state where the cable connector 20 is inserted in and connected to the socket connector 30 so that the contacts of the cable connector 20 are connected to the corresponding contacts of the socket connector 30.

In the socket connector 30, signal contact pairs, each formed of a first signal contact 31 and a second signal contact 32 arranged in the Z-axial directions, and ground contacts 33 are incorporated in an electrically insulating block body 40 illustrated in FIGS. 3A and 3B so as to be arranged alternately with each other in the X-axial directions with a pitch p, being entirely surrounded by a shield cover (not graphically illustrated).

Each of the first and second signal contacts 31 and 32 has a long and narrow shape. Each ground contact 33 has a plate-like shape, and includes a main body part 33*a* and a rectangular projection part 33*b* projecting in the Y2 direction from the main body part 33*a*. The projection part 33*b* includes a cutout part 33*c* formed at the end of the projection part 33*b*.

The socket connector 30 is mounted on a printed board so that each pair of the first and second signal contacts 31 and 32 is connected to a corresponding pair of wiring patterns and the ground contacts 33 are connected to corresponding ground patterns so as to be set to ground potential. Each ground contact 33 has a plate-like shape and provides a shield between the signal contact pair (the first and second signal contacts 31 and 32) on one side of the ground contact 33 and the signal contact pair on the other side of the ground contact 33.

In the cable connector 20, signal contact pairs, each formed of a first signal contact 21 and a second signal contact 22 arranged in the Z-axial directions, and ground contacts 23 are incorporated in an electrically insulating block body (not graphically illustrated) so as to be arranged alternately with each other in the X-axial directions, being entirely surrounded by a shield cover (not graphically illustrated). Each first signal contact 21 includes a plate part 21*a* and a finger part 21*b* extending in the Y1 direction from the plate part 21*a*. Each second signal contact 22 includes a plate part 22*a* and a finger part 22*b* extending in the Y1 direction from the plate part 22*a*. Each ground contact 23 includes a plate part 23*a* and a fork part 23*b* formed of a pair of finger parts extending in the Y1 direction from the plate part 23*a*.

The cable connector 20 is connected to an end of a differential transmission cable containing multiple pairs of wires. Each pair of wires includes a first signal wire, a second signal wire, and a drain wire. The first and second signal contacts 21 and 22 of each signal contact pair are connected to the first signal wire and the second signal wire of the corresponding pair of wires. Each ground contact 23 is connected to the drain wire of the corresponding pair of wires. Each ground contact 23 has a plate-like shape and provides a shield between the signal contact pair (the first and second signal contacts 21 and 22) on one side of the ground contact 23 and the signal contact pair on the other side of the ground contact 23.

The cable connector 20 is inserted into the socket connector 30 in the Y1 direction so as to be connected thereto as illustrated in FIG. 2. A contact surface 21*c* of the finger part 21*b* of each first signal contact 21 of the cable connector 20 rubs on an upper surface 31*a* of the corresponding first signal contact 31 of the socket connector 30 so as to come into contact therewith. A contact surface 22*c* of the finger part 22*b* of each second signal contact 22 of the cable connector 20 rubs on a lower surface 32*a* of the corresponding second signal contact 32 of the socket connector 30 so as to come into contact therewith. Contact surfaces 23*c* and 23*d* of the fork part 23*b* of each ground contact 23 of the cable connector 20 rub on an upper end surface 33*d* and a lower end surface 33*e*, respectively, of the projection part 33*b* of the corresponding ground contact 33 of the socket connector 30 so as to come into contact therewith.

Each first signal contact 21 and the corresponding first signal contact 31 have a "+" signal transmitted thereto. Each second signal contact 22 and the corresponding second signal contact 32 have a "−" signal transmitted thereto. Each first signal contact 21 and the corresponding signal contact 31 and each second signal contact 22 and the corresponding signal contact 32 are shielded by the corresponding ground contacts 23 and 33 from the adjacent first signal contact 21 and the corresponding signal contact 31 and the adjacent second signal contact 22 and the corresponding signal contact 32 along the X-axis. Further, the signals equal in magnitude and opposite in direction are transmitted to each first signal contact 21 and the corresponding signal contact 31 and each second signal contact 22 and the corresponding signal contact 32. Accordingly, a virtual ground plane is formed between the first signal contacts 21 and 31 and the second signal contacts 22 and 32. As a result, the "+" and "−" signals are transmitted in a state less susceptible to noise in any part of the connected cable connector 20 and socket connector 30.

When the cable connector 20 is pulled in the Y2 direction, each finger part 21*b* rubs on the corresponding first signal contact 31, each finger part 22*b* rubs on the corresponding second signal contact 32, and each fork part 23*b* rubs on the corresponding projection part 33*b* so that the cable connector 20 is extracted from the socket connector 30. Japanese Laid-Open Patent Application No. 2000-068006 discloses a conventional differential transmission connector.

The inventors of the present invention evaluated the insertion and extraction durability of the differential transmission connector unit 10. The evaluation was performed by repeating insertion and extraction to measure the differential transmission characteristic of a signal, and recording how the differential transmission characteristic of the signal decreased. As a result, it was found that the differential transmission characteristic of the signal decreased when the number of repetitions of insertion and extraction exceeded a predetermined value.

As a result of observing damage caused to the contact portion of the differential transmission connector unit 10 whose differential transmission characteristic decreased due to the repeated insertion and extraction, the contact portion of the ground contacts 23 and 33 was found to be more damaged than the contact portion of the first and second signal contacts 21 and 22 and the first and second signal contacts 31 and 32.

The reason is considered in the following.

First, a description is given of the process of manufacturing the first signal contacts 31, the second signal contacts 32, and the ground contacts 33 of the socket connector 30.

As illustrated in FIG. 4, a semi-finished product 52 in which the first signal contacts 31 are arranged like comb teeth on a belt part 51 is stamped out by press working from a copper-alloy plate material 50 rolled by a roller. Then, the first signal contacts 31 are bent by press working, subjected to gold-plating, and cut off from the belt part 51 as finished products. The upper surface 31*a* of each first signal contact 31 is a rolled surface subjected to the rolling by the roller.

As illustrated in FIG. 5, a semi-finished product 62 in which the second signal contacts 32 are arranged like comb teeth on a belt part 61 is stamped out by press working from a copper-alloy plate material 60 rolled by a roller. Then, the second signal contacts 32 are bent by press working, subjected to gold-plating, and cut off from the belt part 61 as finished products. The lower surface 32*a* of each second signal contact 32 is a rolled surface subjected to the rolling by the roller.

As illustrated in FIG. 6, a semi-finished product 72 in which the ground contacts 33 are arranged like comb teeth on a belt part 71 is stamped out by press working from a copper-alloy plate material 70 rolled by a roller. Then, the ground contacts 33 are subjected to gold-plating and cut off from the belt part 71 as finished products. The upper end surface 33*d* and the lower end surface 33*e* of the projecting part 33*b* of each ground contact 33 are fracture surfaces due to the press working.

Next, a description is given of the process of manufacturing the first signal contacts 21, the second signal contacts 22, and the ground contacts 23 of the cable connector 20.

As illustrated in FIG. 7, a semi-finished product 82 in which the first and second signal contacts 21 and 22 are arranged like comb teeth on a belt part 81 is stamped out by press working from a copper-alloy plate material 80 rolled by a roller. Then, the first and second signal contacts 21 and 22 are subjected to gold-plating and cut off from the belt part 81 as finished products. The contact surface 21*c* of the finger part 21*b* of each first signal contact 21 and the contact surface 22*c* of the finger part 22*b* of each second signal contact 22 are fracture surfaces due to the press working.

As illustrated in FIG. 8, a semi-finished product 92 in which the ground contacts 23 are arranged like comb teeth on a belt part 91 is stamped out by press working from a copper-alloy plate material 90 rolled by a roller. Then, the ground contacts 23 are subjected to gold-plating and cut off from the belt part 91 as finished products. The opposing contact surfaces 23*c* and 23*d* of the fork part 23*b* of each ground contact 23 are fracture surfaces due to the press working.

Here, the fracture surfaces due to press working were found to be considerably rough compared with rolled surfaces, and it was found that the gold plating layer on the fracture surfaces rubs off easily compared with that on rolled surfaces.

Referring again to FIGS. 1 and 2, the fracture contact surfaces 21*c* and 22*c* of the first and second signal contacts 21 and 22 rub on the rolled upper and lower surfaces 31*a* and 32*a* of the first and second signal contacts 31 and 32, respectively. On the other hand, the fracture contact surfaces 23*c* and 23*d* of the ground contacts 23 rub on the fracture upper and lower end surfaces 33*d* and 33*e*, respectively, of the ground contacts 33.

Since the fracture surfaces rub on each other, the gold plating layer of each of the ground contacts 23 and 33 is scraped off considerably so that the base surface is exposed so as to increase the contact resistance of the contact part, which was found out to be the reason why the insertion and extraction durability is prevented from increasing.

SUMMARY OF THE INVENTION

Accordingly, it is a general object of the present invention to provide a differential transmission connector unit in which the above-described disadvantage is eliminated.

A more specific object of the present invention is to provide a differential transmission connector unit having an increased insertion and extraction durability.

The above objects of the present invention are achieved by a differential transmission connector unit including: a first differential transmission connector including a first electrically insulating block body; and at least one first signal contact pair and at least one first ground contact arranged alternately in a row in the first electrically insulating block body; and a second differential transmission connector including a second electrically insulating block body; and at least one second signal contact pair and at least one second ground contact arranged alternately in a row in the second electrically insulating block body, wherein the first differential transmission connector is connected to the second differential transmission connector with the first signal contact pair and the second signal contact pair being in contact with each other and the first ground contact and the second ground contact being in contact with each other; and one of a contact surface of the first ground contact and a contact surface of the second ground contact is a rolled surface, the contact surfaces contacting each other.

The above objects of the present invention are also achieved by a differential transmission connector unit including: a first differential transmission connector including a first electrically insulating block body; and at least one first signal contact pair and at least one first ground contact arranged alternately in a row in the first electrically insulating block body; and a second differential transmission connector including a second electrically insulating block body; and at least one second signal contact pair and at least one second ground contact arranged alternately in a row in the second electrically insulating block body, wherein the first differential transmission connector is connected to the second differential transmission connector with the first signal contact pair and the second signal contact pair being in contact with each other and the first ground contact and the second ground contact being in contact with each other; and a contact surface of the first ground contact and a contact surface of the second ground contact are rolled surfaces, the contact surfaces contacting each other.

According to each of the above-described differential transmission connector units, at least one of the first and second differential transmission connectors of a differential transmission connector unit includes a ground contact having a rolled contact surface. Accordingly, even when the contact surface of a ground contact of the other one of the first and second differential transmission connectors rubs on and comes into contact with the rolled contact surface, the scraping-off of the gold-plated layer of the contact surface of the ground contact of each of the connectors is delayed, so that the insertion and extraction durability of the differential transmission connector unit increases.

The above objects of the present invention are also achieved by a ground contact for a differential transmission connector having an electrically insulating block body in which the ground contact and a pair of first and second signal contacts are to be arranged in a row, the ground contact including: a plate-like main body part; and first and second finger parts opposing each other, the first and second finger parts being formed by bending a part of a plate material having a rolled surface, wherein a surface of the first finger part facing away from the second finger part and a surface of the second finger part facing away from the first finger part are rolled surfaces.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given below, with reference to the accompanying drawings, of embodiments of the present invention.

First Embodiment

Figure 9:
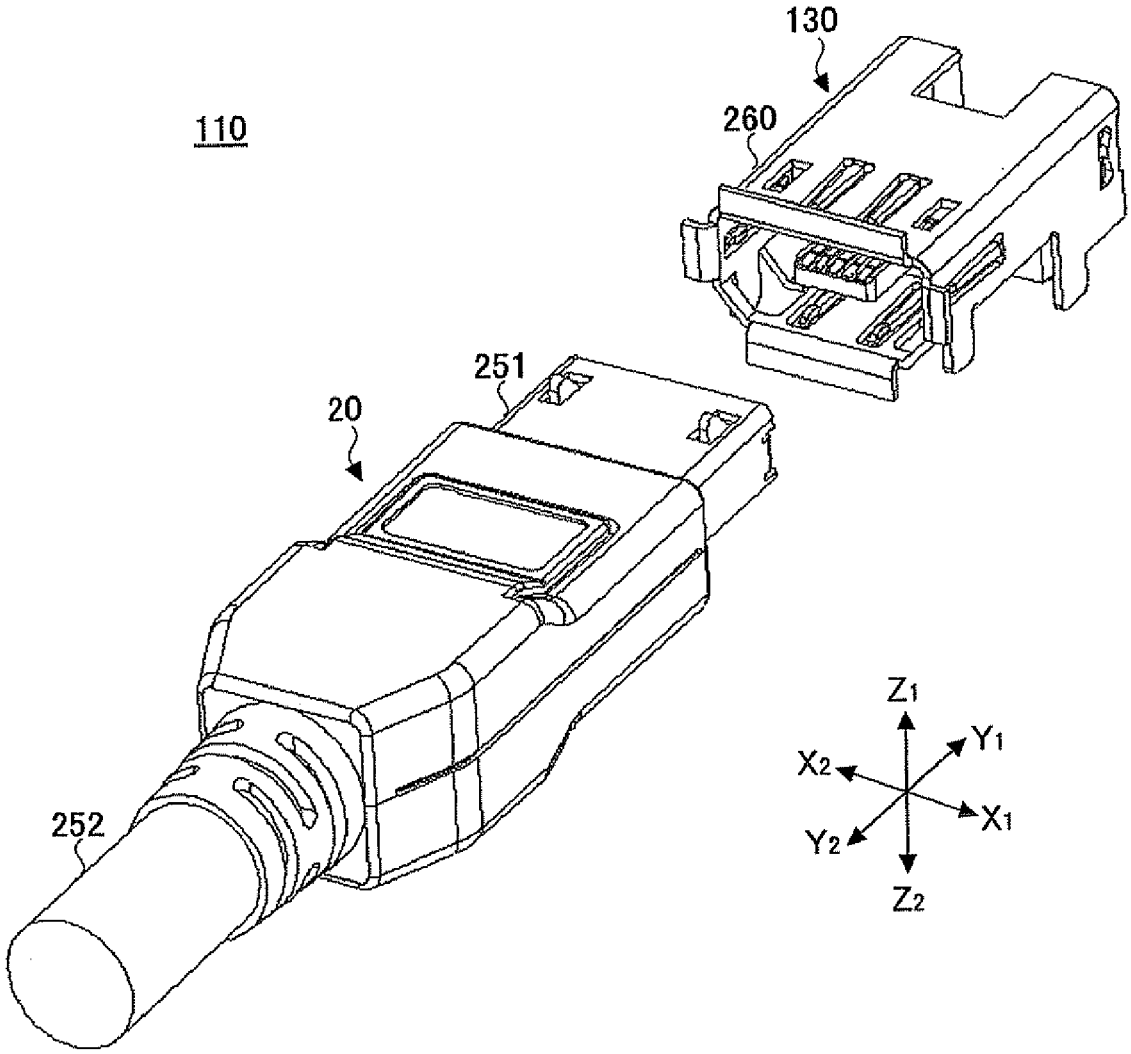
FIG. 9 is a diagram illustrating a cable connector and a socket connector forming a differential transmission connector unit according to a first embodiment of the present invention.
Figure 10:
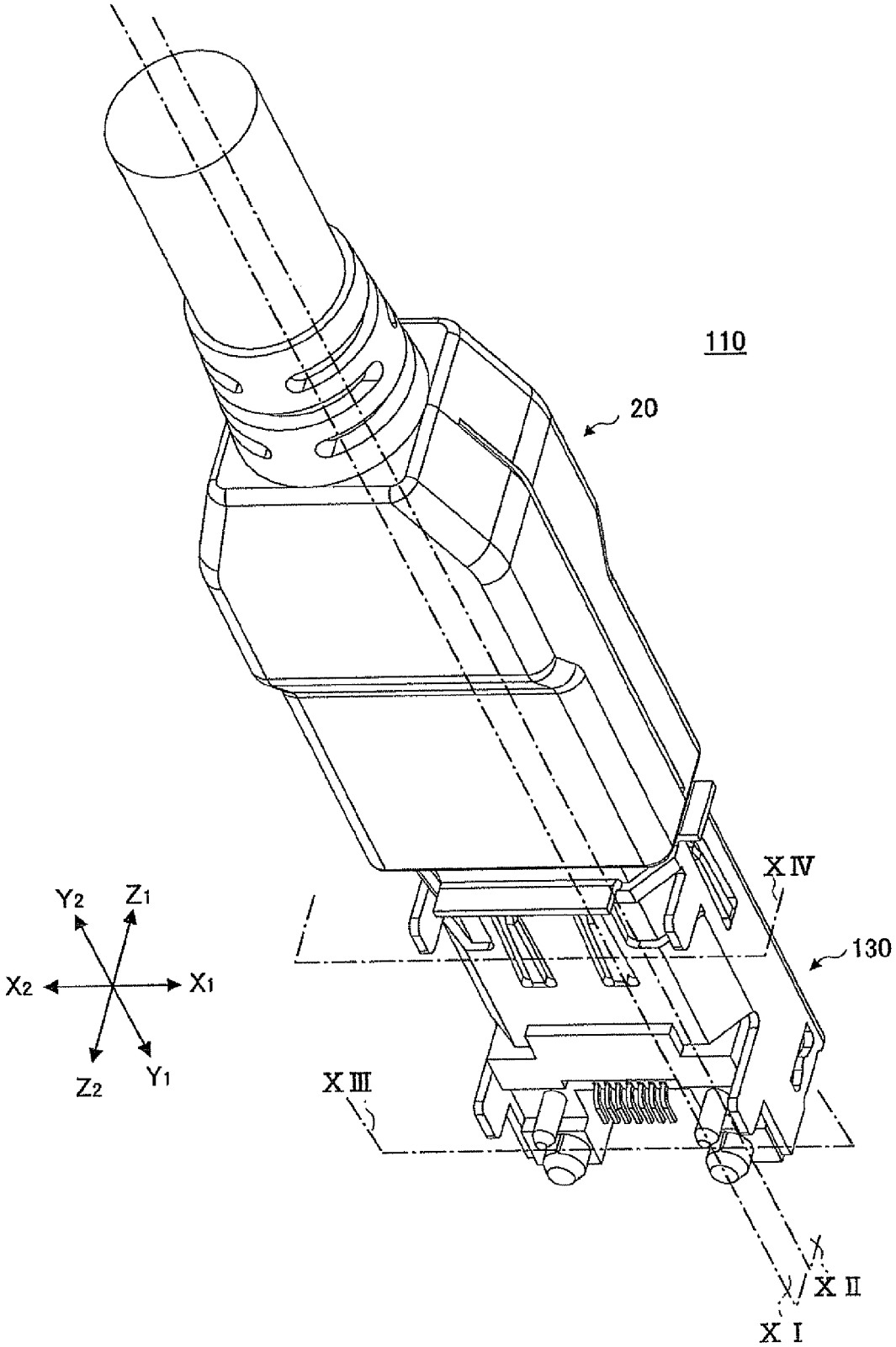
FIG. 10 is a perspective view of the differential transmission connector unit in a state where the cable connector and the socket connector are connected to each other according to the first embodiment of the present invention.

FIGS. 9 and 10 are diagrams illustrating a connector unit for differential transmission (differential transmission connector unit) 110 according to a first embodiment of the present invention. The differential transmission connector unit 110 includes a socket connector 130 to be mounted on a printed board and the cable connector 20 at a cable end. The socket connector 130 is different in configuration from the socket connector 30 of the differential transmission connector unit 10 illustrated in FIG. 1.

Figure 11:
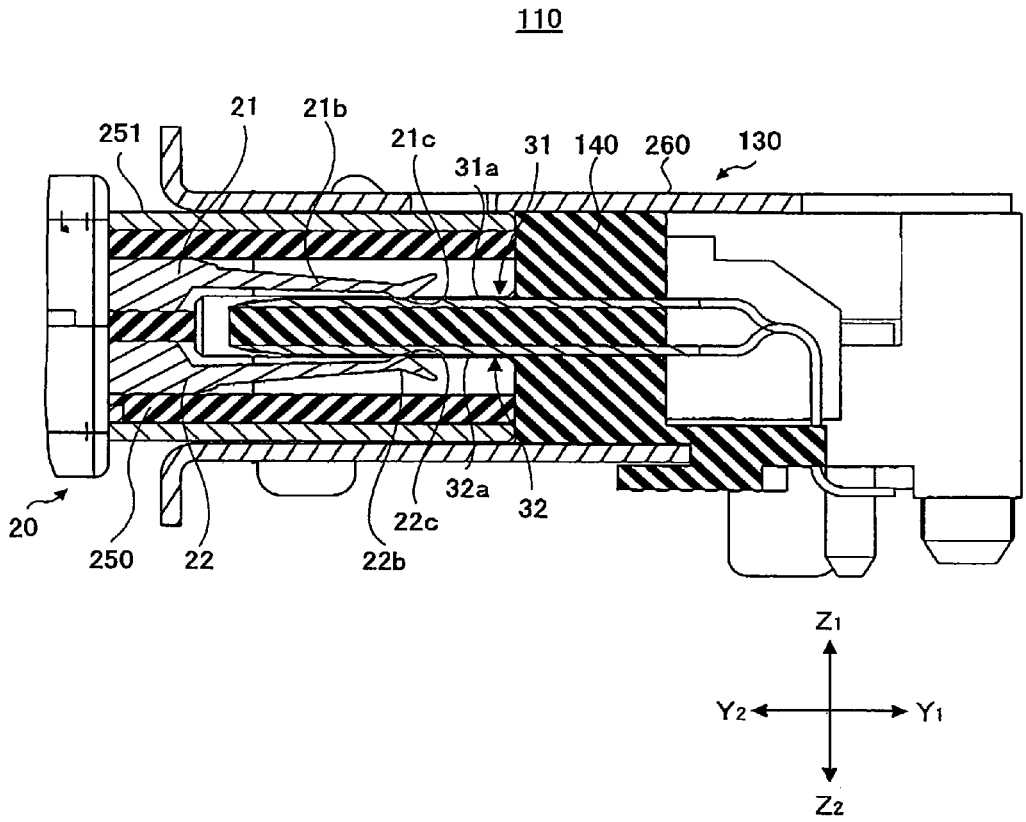
FIG. 11 is a longitudinal sectional view of the differential transmission connector unit of FIG. 10 taken along the plane XI, illustrating the connection state of signal contacts, according to the first embodiment of the present invention.
Figure 12:
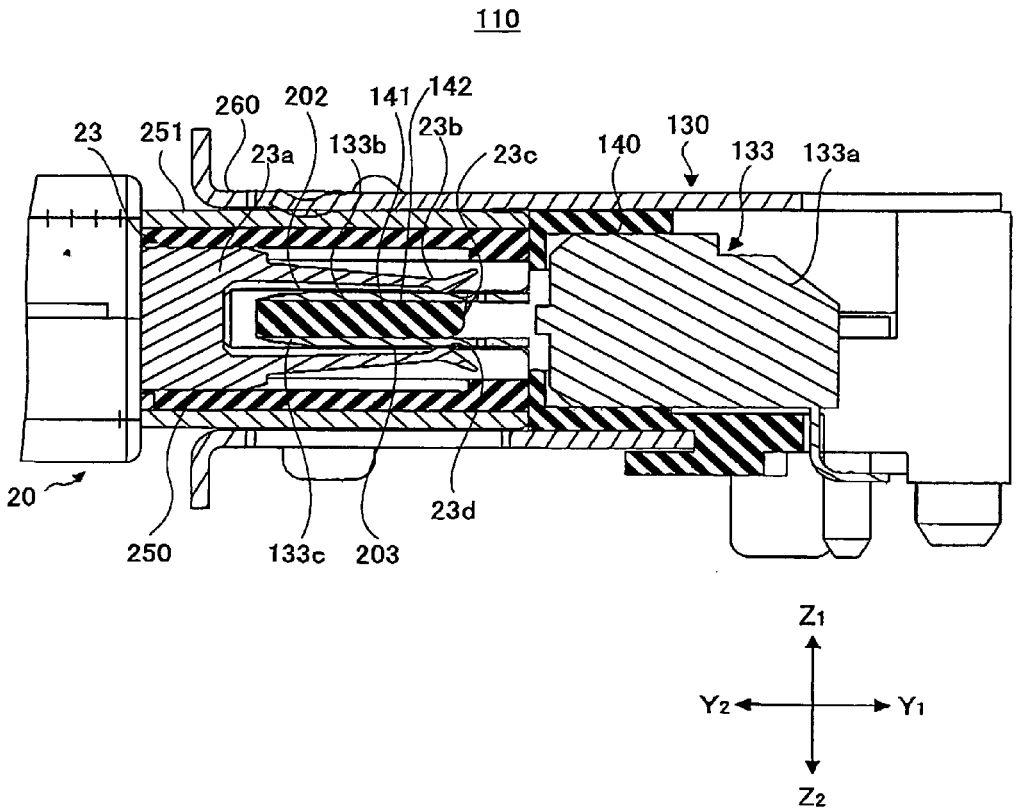
FIG. 12 is a longitudinal sectional view of the differential transmission connector unit of FIG. 10 taken along the plane XII, illustrating the connection state of ground contacts, according to the first embodiment of the present invention.
Figure 13:
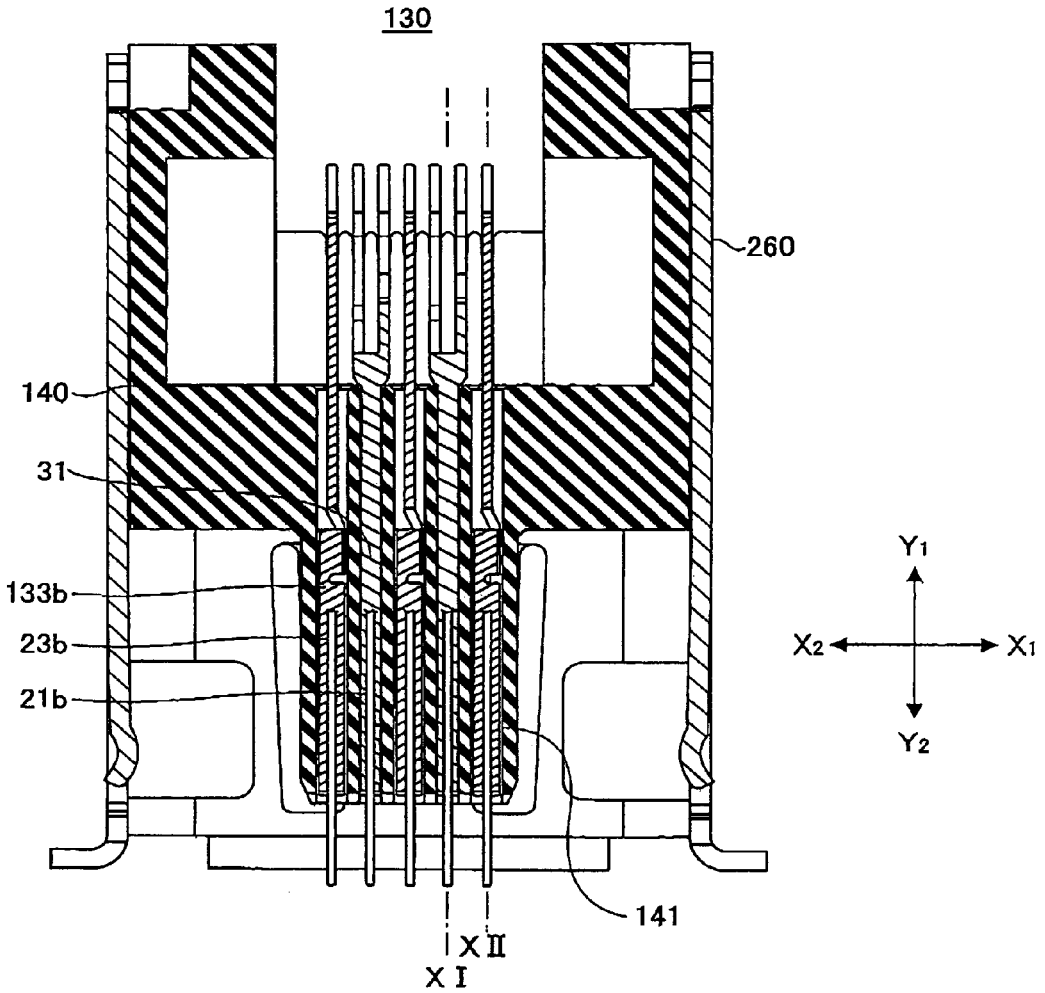
FIG. 13 is a Z1-side sectional view of part of the differential transmission connector unit of FIG. 10 taken along the plane XIII, illustrating the connection state of signal contacts and the connection state of ground contacts, according to the first embodiment of the present invention.
Figure 14:
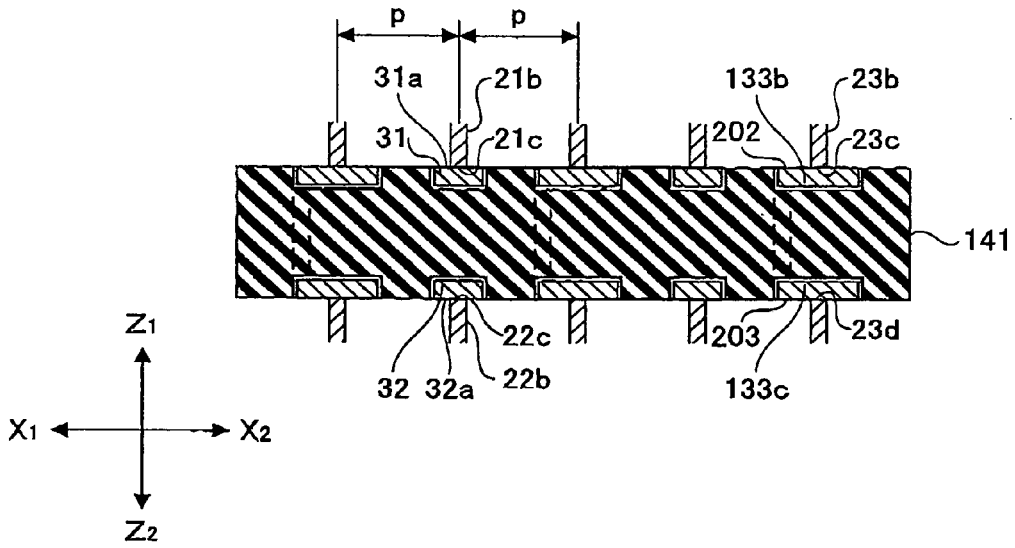
FIG. 14 is a Y2-side cross-sectional view of the differential transmission connector unit of FIG. 10 taken along the plane XIV, illustrating the connection state of signal contacts and the connection state of ground contacts, according to the first embodiment of the present invention.

FIG. 9 illustrates a state where the cable connector 20 and the socket connector 130 oppose each other. FIGS. 10 through 14 are diagrams each illustrating a state where the cable connector 20 is inserted in the socket connector 130 to be connected thereto. FIG. 10 is a bottom perspective view of the differential transmission connector unit 110. FIG. 11 is a longitudinal sectional view of the differential transmission connector unit 110 of FIG. 10 taken along the plane XI, illustrating the connection state of signal contacts. FIG. 12 is a longitudinal sectional view of the differential transmission connector unit 110 of FIG. 10 taken along the plane XII, illustrating the connection state of ground contacts. FIG. 13 is a Z1-side sectional view of part of the differential transmission connector unit 110 of FIG. 10 taken along the plane XIII, illustrating the connection state of signal contacts and the connection state of ground contacts. FIG. 14 is a Y2-side cross-sectional view of the differential transmission connector unit 110 of FIG. 10 taken along the plane XIV, illustrating the connection state of signal contacts and the connection state of ground contacts.

Figure 15:
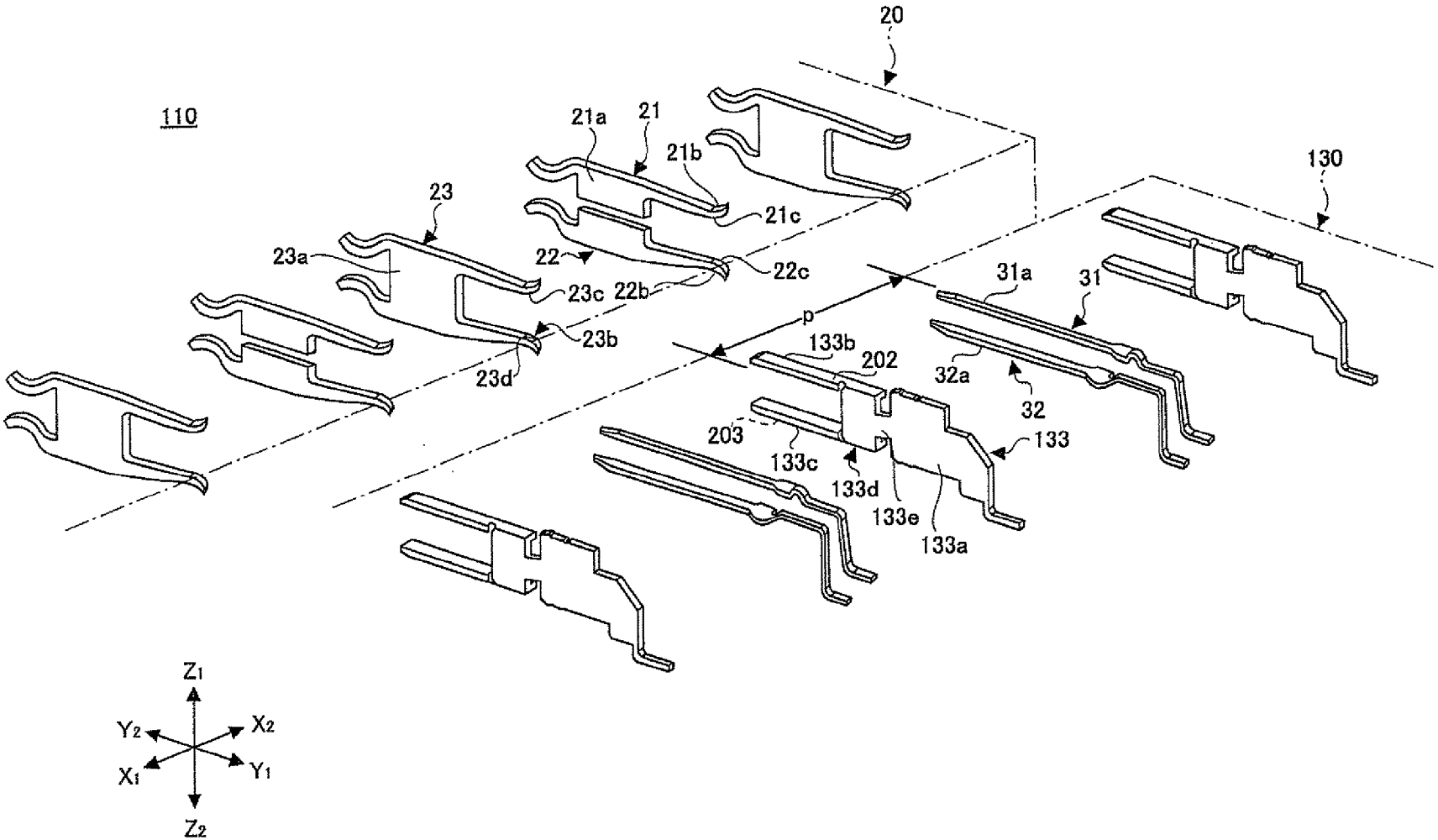
FIG. 15 is a schematic diagram illustrating a state where the contacts of the cable connector and the contacts of the socket connector oppose each other according to the first embodiment of the present invention.
Figure 16:
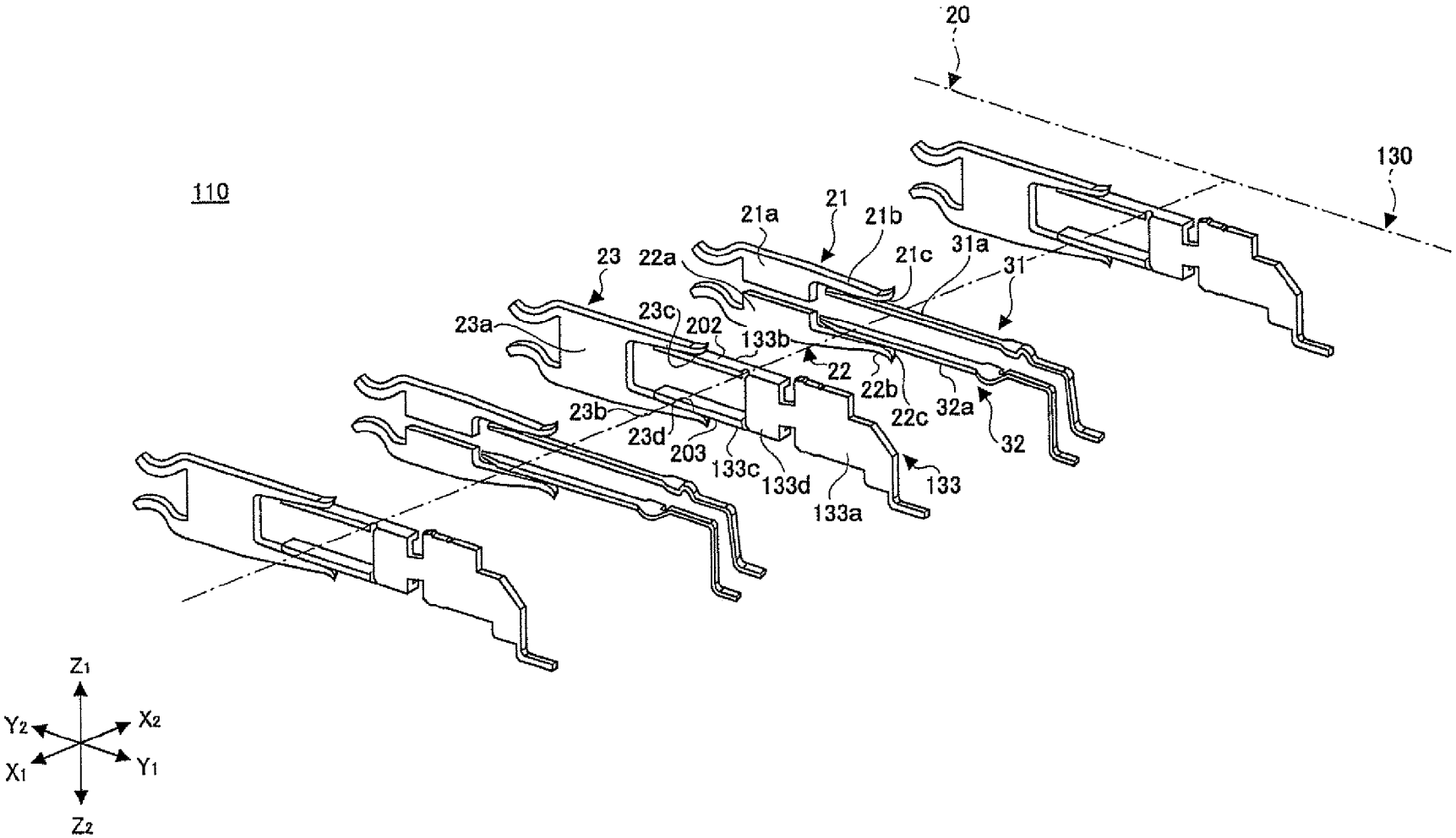
FIG. 16 is a schematic diagram illustrating a state where the cable connector is inserted in and connected to the socket connector so that the contacts of the cable connector are connected to the corresponding contacts of the socket connector according to the first embodiment of the present invention.

FIG. 15 is a schematic diagram illustrating a state where the contacts of the cable connector 20 and the contacts of the socket connector 130 oppose each other. FIG. 16 is a schematic diagram illustrating a state where the cable connector 20 is inserted in and connected to the socket connector 130 so that the contacts of the cable connector 20 are connected to the corresponding contacts of the socket connector 130.

Figure 1:
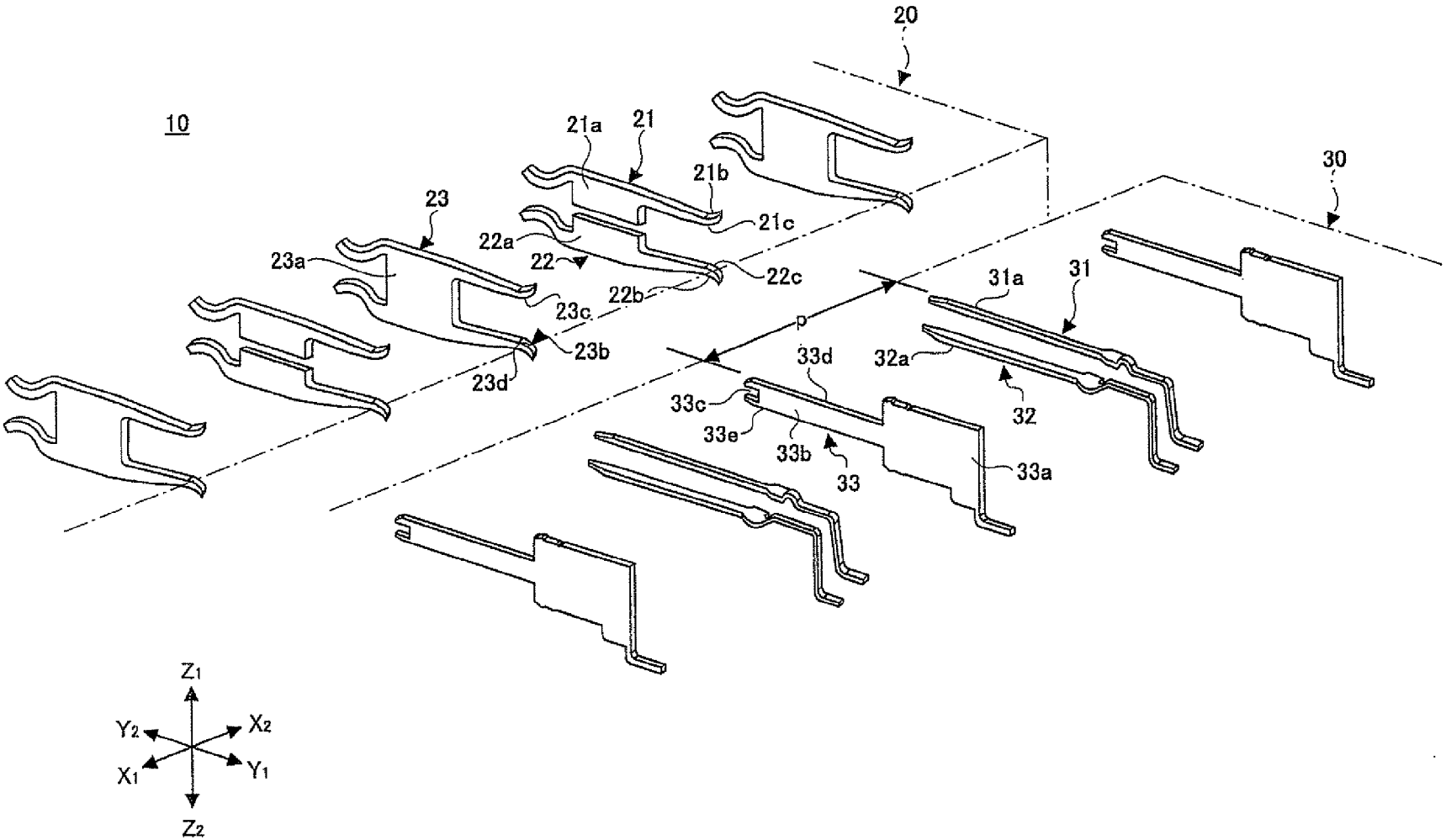
FIG.1 PRIOR ART
FIG. 1 is a schematic diagram illustrating signal contacts and ground contacts of a conventional differential transmission connector unit in a non-contact state.
Figure 2:
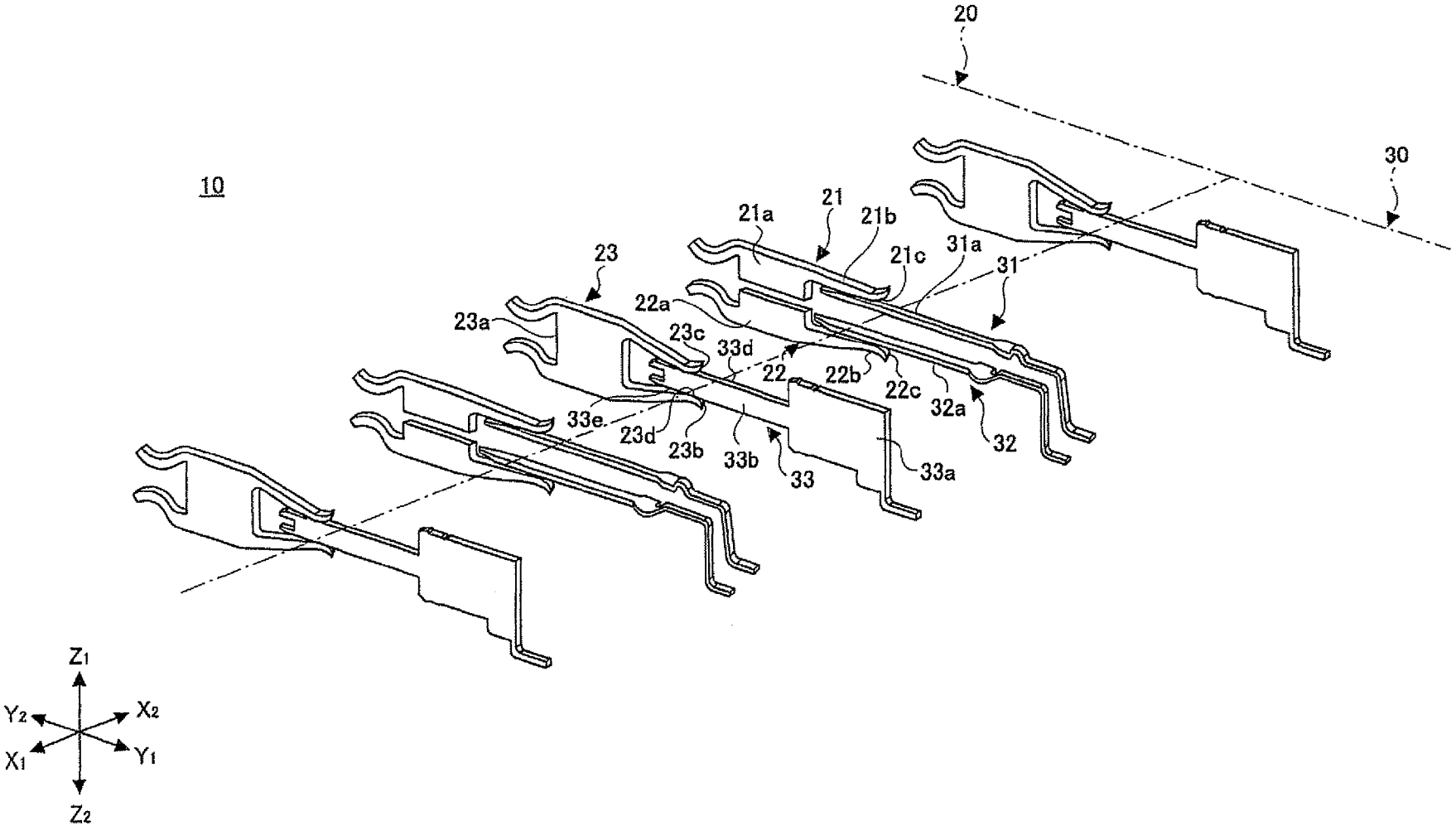
FIG.2 PRIOR ART
FIG. 2 is a schematic diagram illustrating the signal contacts and the ground contacts of the conventional differential transmission connector unit in a contact state.

The cable connector 20 is equal to that illustrated in FIG. 1. In the cable connector 20, the signal contact pairs, each formed of the first and second signal contacts 21 and 22 arranged in the Z-axial directions, and the ground contacts 23 are incorporated in an electrically insulating block body 250 (FIGS. 11 and 12) so as to be arranged alternately with each other in the X-axial directions, being entirely surrounded by a shield cover 251 (FIGS. 9, 11 and 12). The cable connector 20 is connected to an end of a differential transmission cable 252 (FIG. 9) containing multiple pairs of wires.

The socket connector 130 includes ground contacts 133, which are different from the ground contacts 33 of the socket connector 30 illustrated in FIG. 1. As a result of this difference, the socket connector 130 includes an electrically insulating block body 140 (FIGS. 17, 18A and 18B) different from the conventional block body employed in the socket connector 30.

Figure 17:
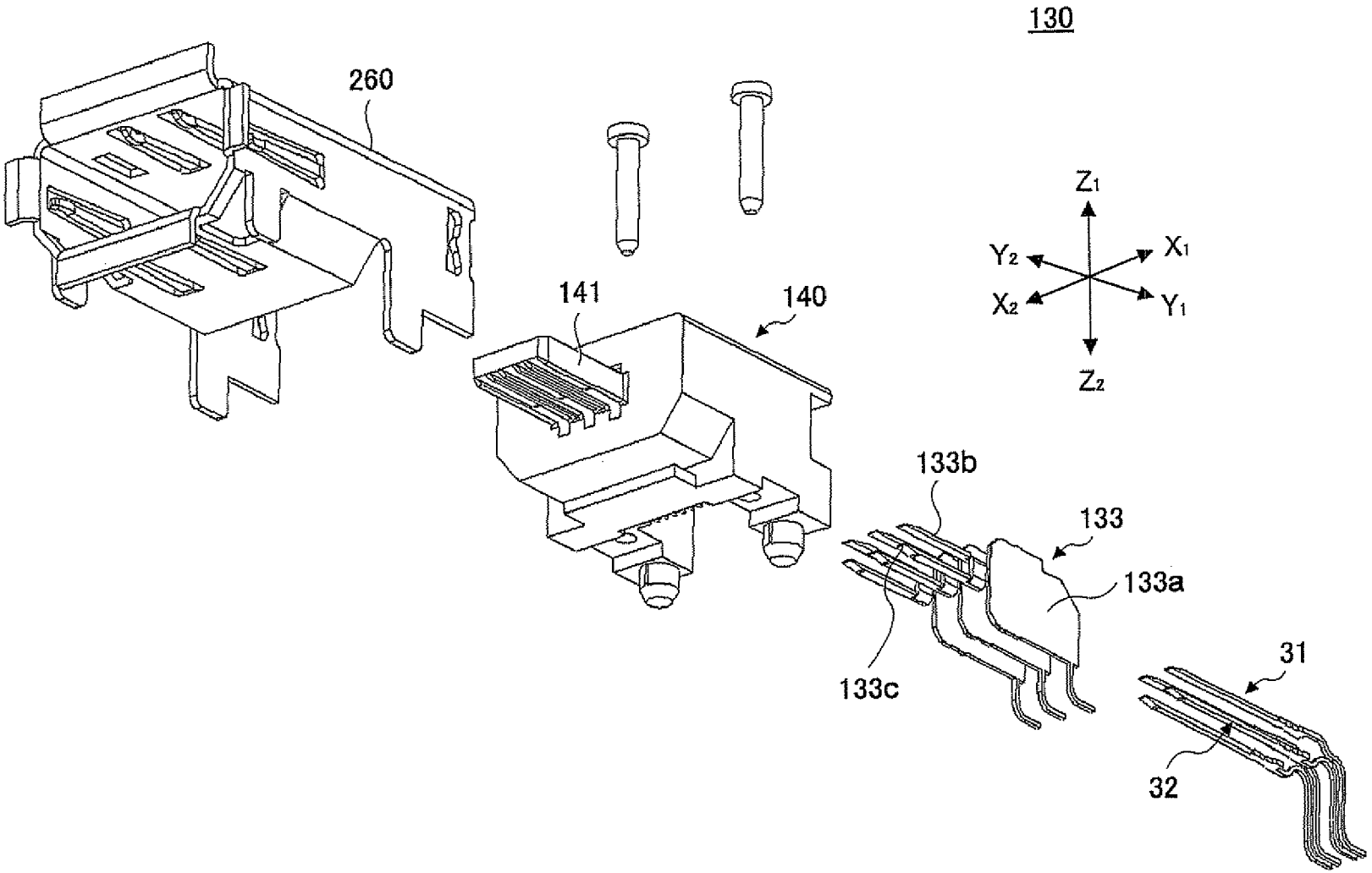
FIG. 17 is an exploded perspective view of the socket connector according to the first embodiment of the present invention.

FIG. 17 is an exploded perspective view of the socket connector 130. As illustrated in FIG. 17, in the socket connector 130, the signal contact pairs, each formed of the first and second signal contacts 31 and 32 arranged in the Z-axial directions, and the ground contacts 133 are incorporated in the electrically insulating block body 140 illustrated in FIGS. 18A and 18B so as to be arranged alternately with each other in the X-axial directions, being entirely surrounded by a shield cover 260.

Each of the first and second signal contacts 31 and 32 has a long and narrow shape. The upper surface 31*a* of each first signal contact 31 and the lower surface 32*a* of each second signal contact 32 are rolled surfaces rolled by a roller.

As illustrated in FIGS. 19A and 19B and 20A through 20E, each ground contact 133 includes a plate-like main body part 133*a*, first and second finger parts 133*b* and 133*c* arranged in the Z-axial directions and projecting in the Y2 direction from the main body part 133*a*, a U-shaped base part 133*d* provided at the root (base) of the first and second finger parts 133*b* and 133*c*, and a connection part 133*e* connecting the main body part 133*a* and the U-shaped base part 133*d*. The U-shaped base part 133*d* includes an opening in the X2 direction so as to have a U-letter shape in the X-axial directions when viewed in the Y-axial directions. The main body part 133*a* has a thickness t (FIG. 19A) of 0.4 mm. Each of the first and second finger parts 133*b* and 133*c* has a width w (FIG. 19A) of 0.6-0.7 mm. A space 133*f* is formed between the finger parts 133*b* and 133*c* so as to extend from the Y2 end of each of the finger parts 133*b* and 133*c* to the U-shaped base part 133*d*. The U-shaped base part 133*d* includes a main body part 133*d*-1 and bent parts 133*d*-2 and 133*d*-3.

Figure 21:
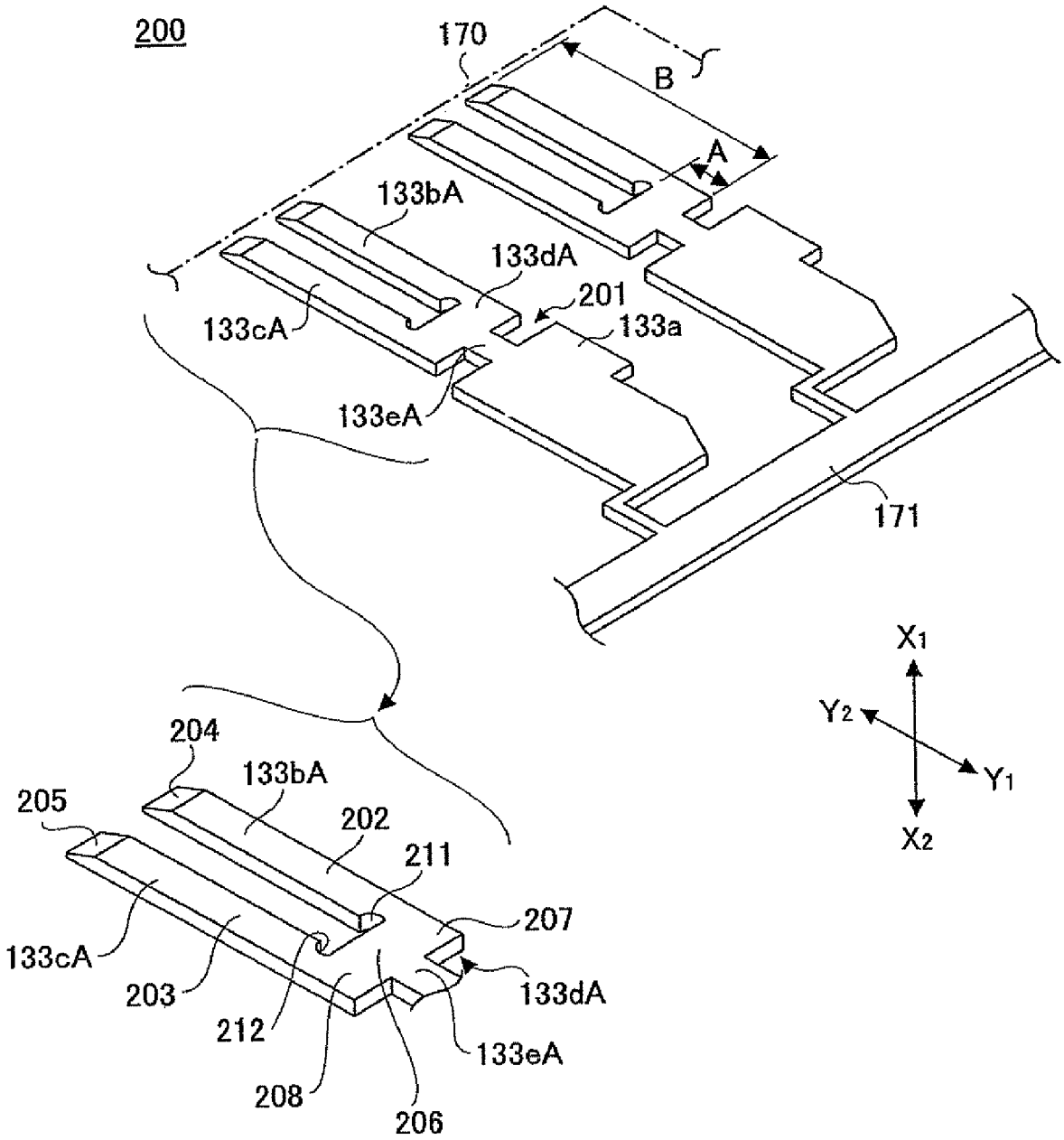
FIGS. 21 through 23 are diagrams for illustrating a process of manufacturing the ground contacts of the socket connector according to the first embodiment of the present invention.
Figure 22:
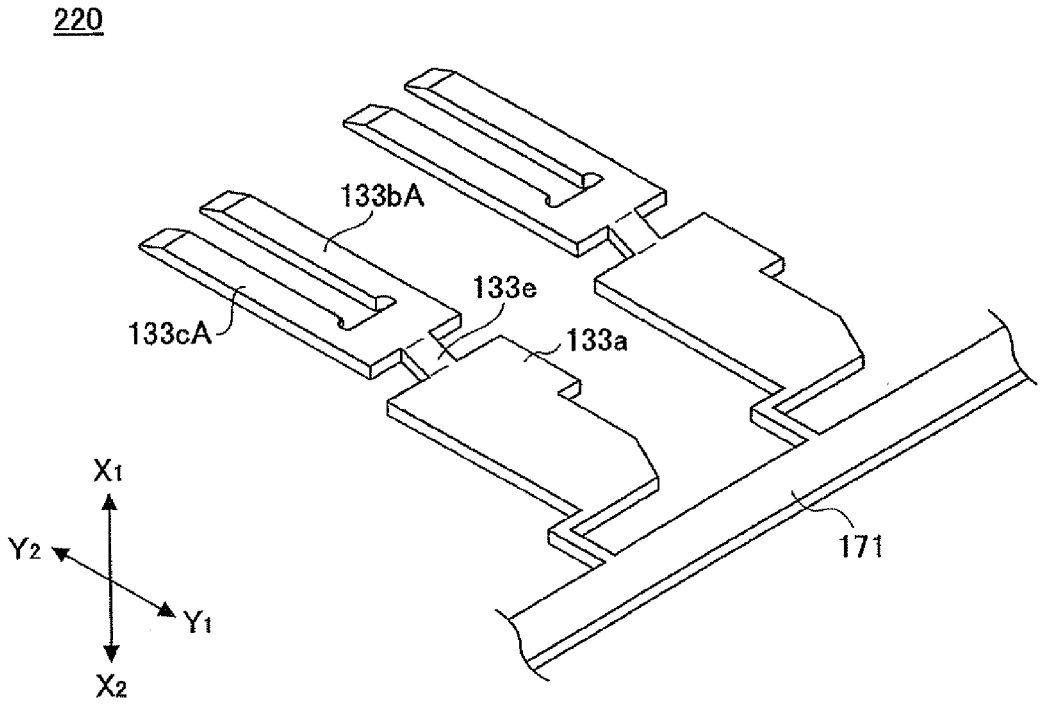
Figure 23:
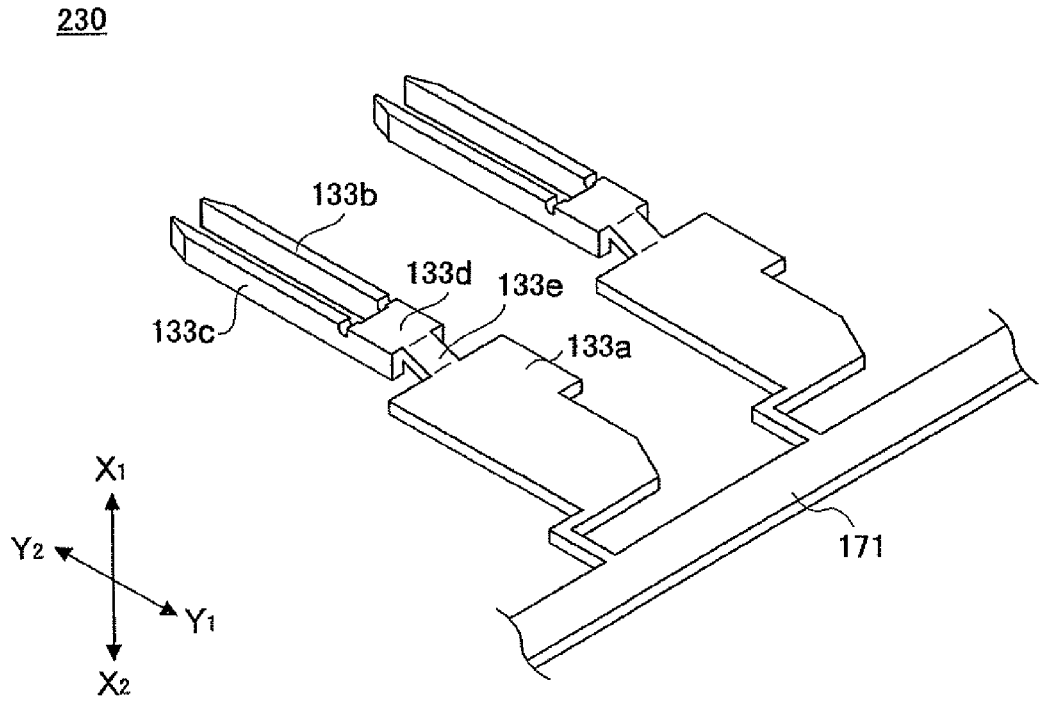

The ground contacts 133 are manufactured as illustrated in FIGS. 21, 22 and 23. FIG. 21 illustrates a first semi-finished product 200 stamped out by press working from a copper-alloy plate material 170 rolled by a roller. Multiple flat-surface spread-out ground contacts 201 are arranged like comb teeth on a belt part 171. In each spread-out ground contact 201, a flat connection part 133*e*A, a spread-out U-shaped base part 133*d*A, and spread-out finger parts 133*b*A and 133*c*A project in the Y2 direction from the main body part 133*a*.

Z1-side surfaces 202 and 203 of the spread-out finger parts 133*b*A and 133*c*A together with their Z2-side surfaces are rolled surfaces rolled by a roller. The spread-out finger parts 133*b*A and 133*c*A include slope parts 204 and 205 formed on their respective Y2 ends by pressing using a press.

The spread-out U-shaped base part 133*d*A includes a base main body part 206 and extension parts 207 and 208 extending on both sides from the base main body part 206. The base main body part 206 finally forms the main body part 133*d*-1 of the U-shaped base part 133*d* of the ground contact 133. The extension parts 207 and 208 finally form the bent parts 133*d*-2 and 133*d*-3, respectively, forming the root (base) parts of the finger parts 133*b* and 133*c*.

The length (Y1-Y2 dimension) A of the spread-out U-shaped base part 133*d*A is as short as, for instance, one nth (n=2-9) of the length (Y1-Y2 dimension) B of each of the spread-out finger parts 133*b*A and 133*c*A including the extension parts 207 and 208, respectively. Since the length A of the spread-out U-shaped base part 133*d*A is short, it is easy to perform below-described bending.

On the Y2 side of the spread-out U-shaped base part 133*d*A, cut parts 211 and 212 are formed in the spread-out finger parts 133*b*A and 133*c*A, respectively. The cut parts 211 and 212 are formed so as to facilitate the bending of the extension parts 207 and 208 at right angles to the base main body part 206.

The flat connection part 133*e*A is connected to the base main body part 206 of the spread-out U-shaped base part 133*d*A.

FIG. 22 illustrates a second semi-finished product 220. The second semi-finished product 220 is formed by performing press working on the first semi-finished product 200 so that the flat connection part 133*e*A of each spread-out ground contact 201 is bent like a crank in the X1 direction so as to form the connection part 133*e*.

FIG. 23 illustrates a third semi-finished product 230. The third semi-finished product 230 is formed by performing press working on the second semi-finished product 220 so that the extension parts 207 and 208 of the spread-out U-shaped base part 133*d*A are bent in the X2 direction so as to form the U-shaped base part 133*d* and the finger parts 133*b* and 133*c*.

Here, since the length A of the spread-out U-shaped base part 133*d*A is short, it is easy to perform the above-described bending. Further, since the cut parts 211 and 212 are provided, the extension parts 207 and 208 are bent so that both angles □1 and □2 that the extension parts 207 and 208 respectively form with respect to the base main body part 206 become 90□ and each of the finger parts 133*b* and 133*c* forms an angle of 90□ to the main body part 133*a*.

Next, gold plating is performed, and the ground contacts 133 are cut off from the belt part 171 as finished products. Both upper and lower surfaces 202 and 203 of the finger parts 133*b* and 133*c* are rolled surfaces rolled by a roller.

Figures 20A, 20B, 20C, 20D, 20E:
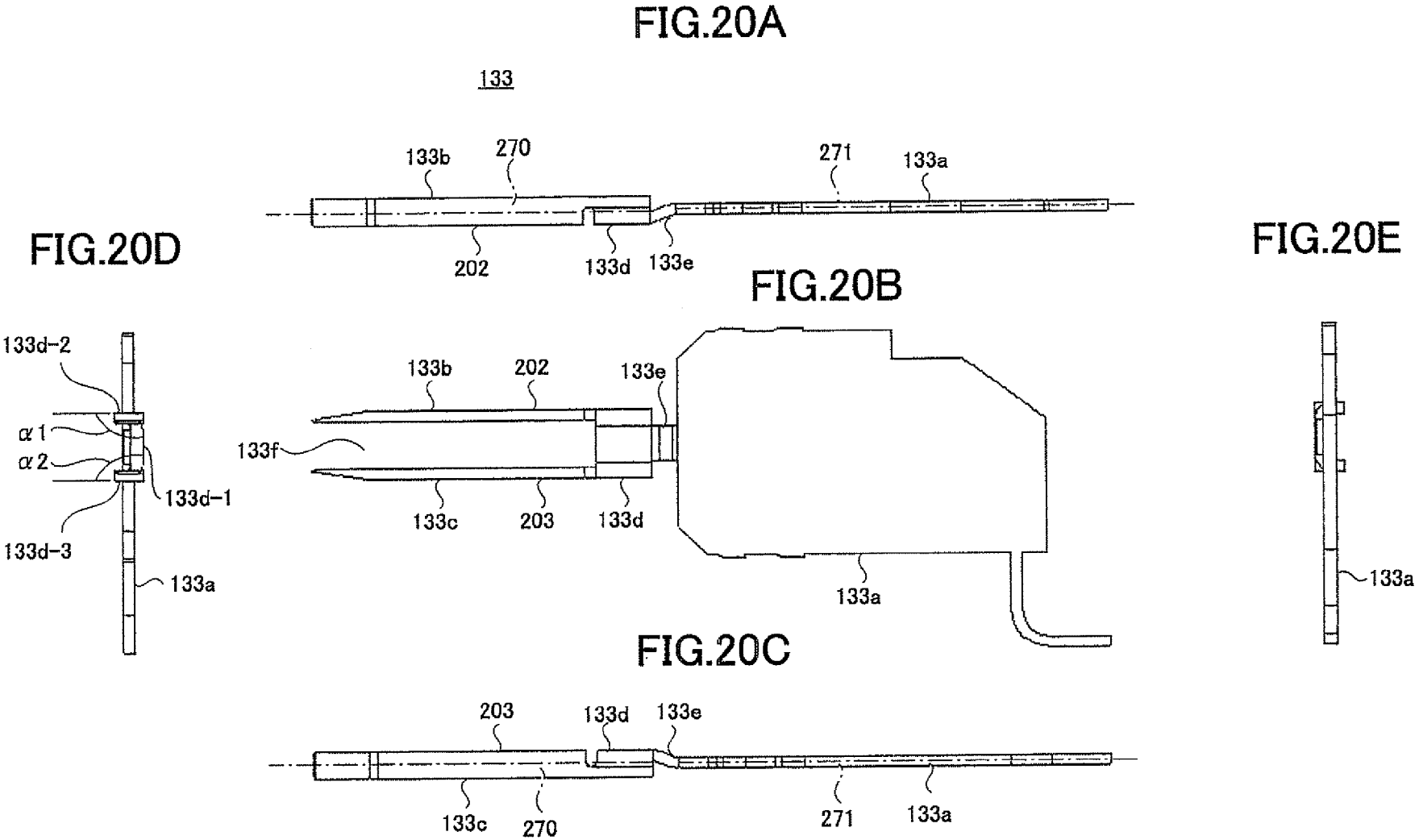
FIGS. 20A through 20E are diagrams illustrating the ground contact of the socket connector according to the first embodiment of the present invention.

Since the connection part 133*e* has a crank-like shape, the main body part 133*a* and the finger parts 133*b* and 133*c* are positioned so that a center line 270 of the width w of each of the finger parts 133*b* and 133*c* is aligned with (or coincides with) a center line 271 of the thickness t (X1-X2 dimension) of the main body part 133*a* as illustrated in FIGS. 20A and 20C.

Figure 3A:
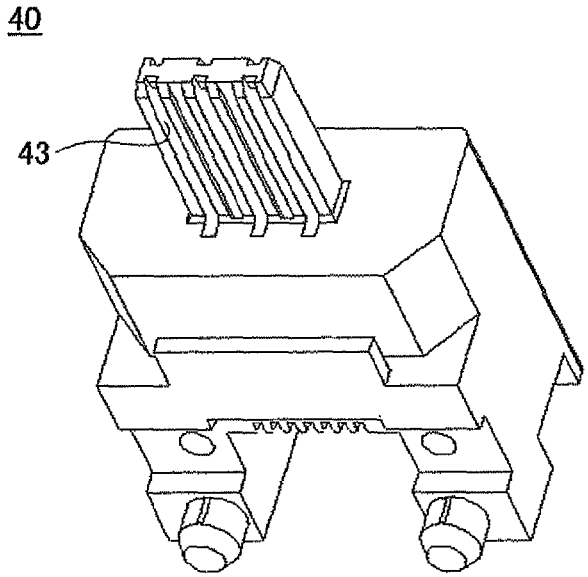
FIG.3A PRIOR ART
FIGS. 3A and 3B are a perspective view and a plan view, respectively, of a block body of a socket connector of the conventional differential transmission connector unit.
Figure 3B:
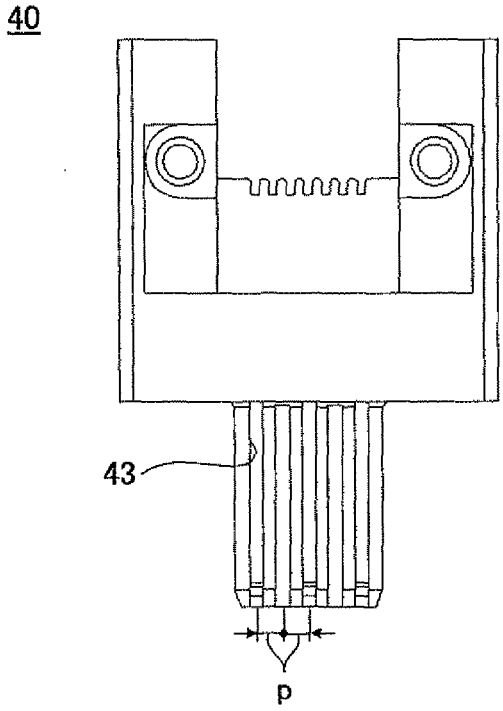
FIG.3B PRIOR ART
Figure 4:
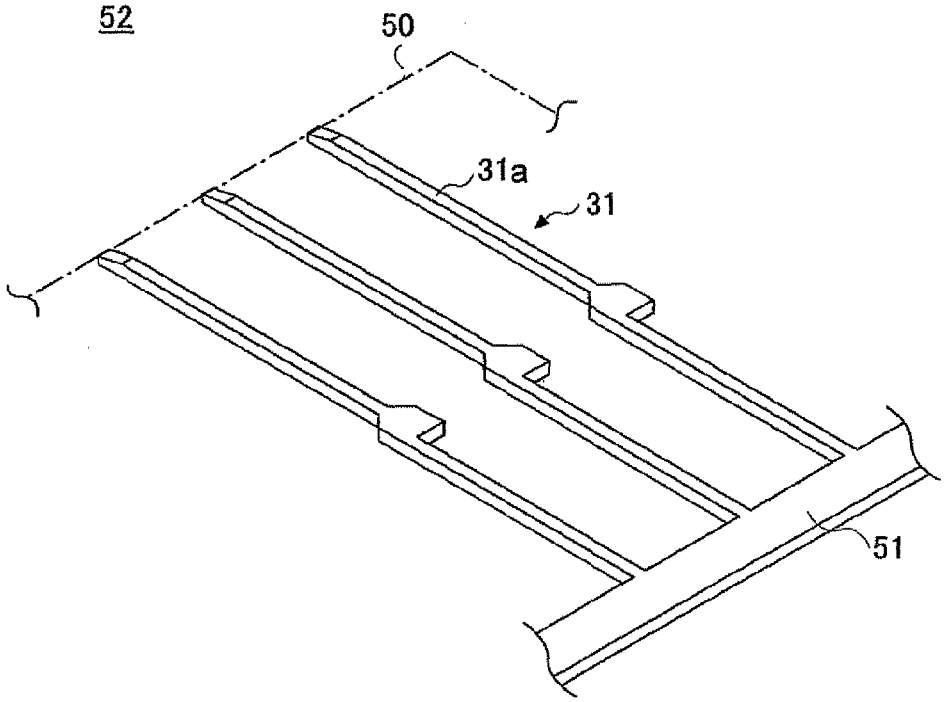
FIG.4 PRIOR ART
FIG. 4 is a diagram for illustrating a process of manufacturing the first signal contacts of the conventional socket connector.
Figure 5:
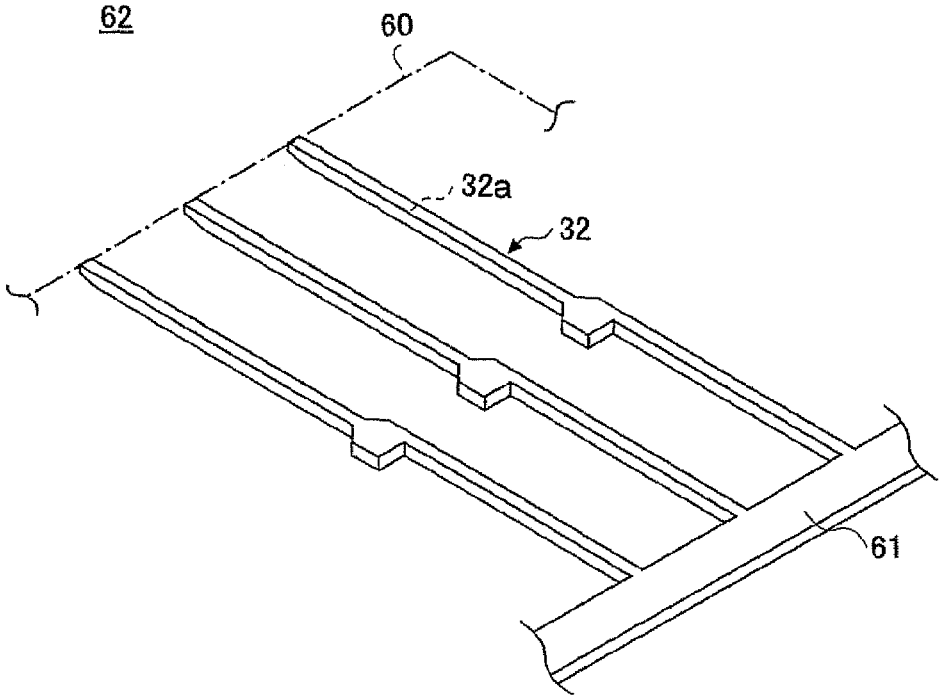
FIG.5 PRIOR ART
FIG. 5 is a diagram for illustrating a process of manufacturing the second signal contacts of the conventional socket connector.
Figure 6:
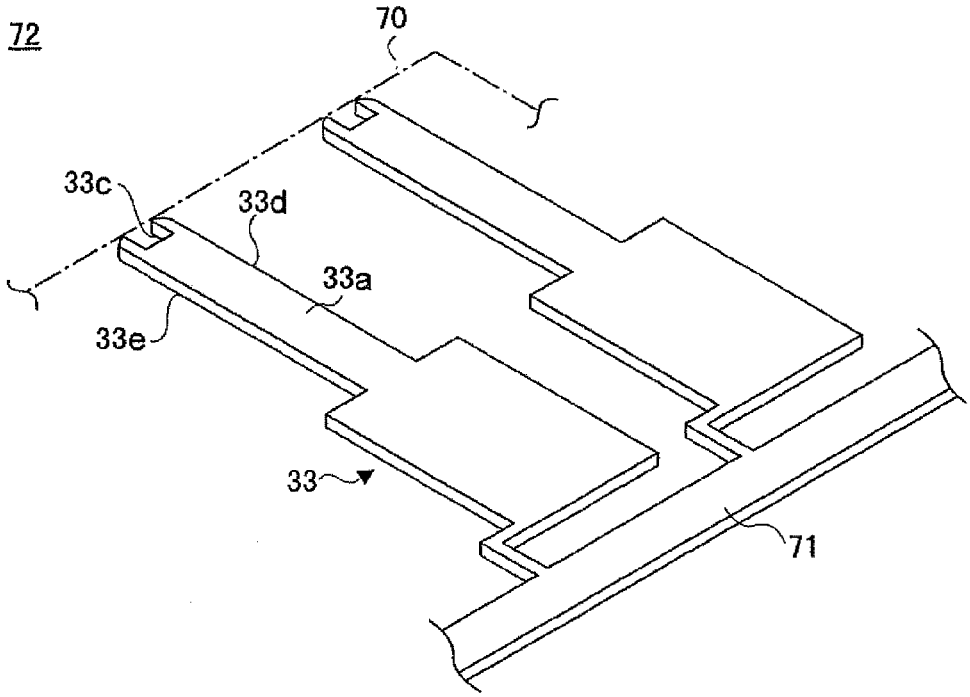
FIG.6 PRIOR ART
FIG. 6 is a diagram for illustrating a process of manufacturing the ground contacts of the conventional socket connector.
Figure 7:
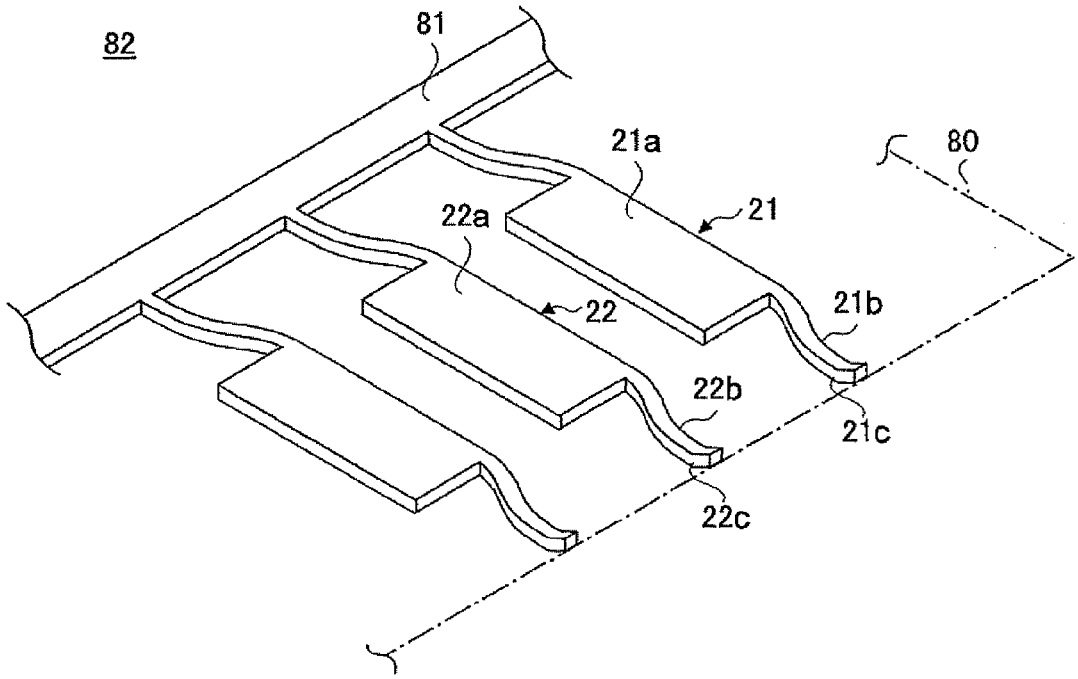
FIG.7 PRIOR ART
FIG. 7 is a diagram for illustrating a process of manufacturing the first and second signal contacts of a cable connector of the conventional differential transmission connector unit.
Figure 18A:
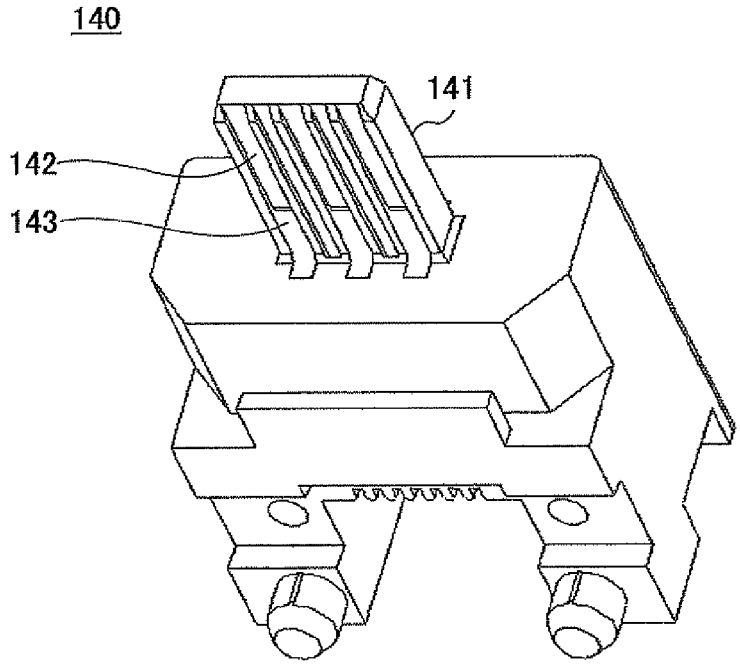
FIGS. 18A and 18B are a perspective view and a plan view, respectively of a block body of the socket connector according to the first embodiment of the present invention.
Figure 18B:
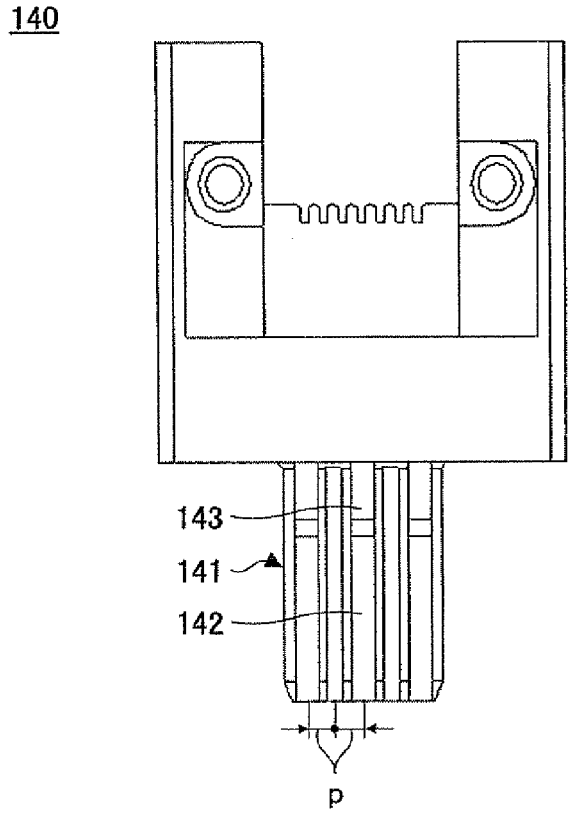
Figure 19A:
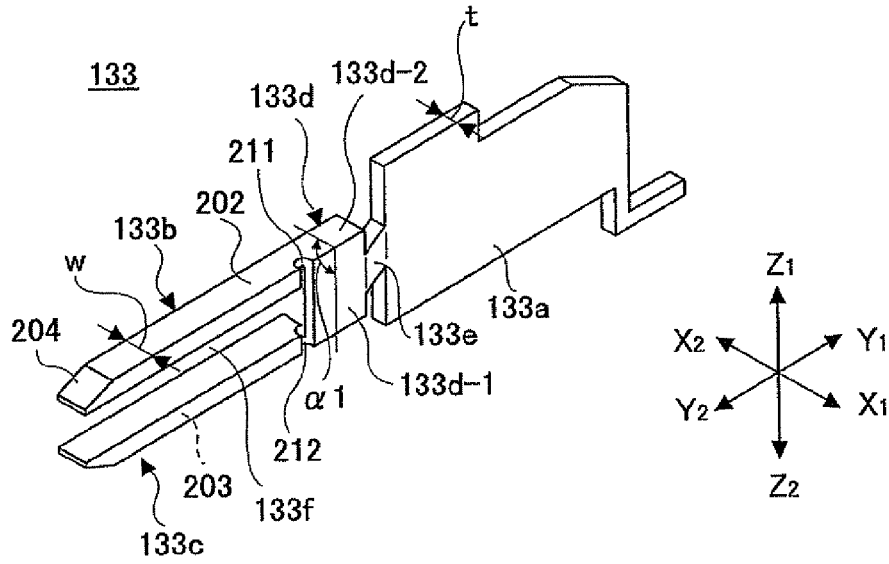
FIGS. 19A and 19B are perspective views illustrating a ground contact of the socket connector according to the first embodiment of the present invention.
Figure 19B:
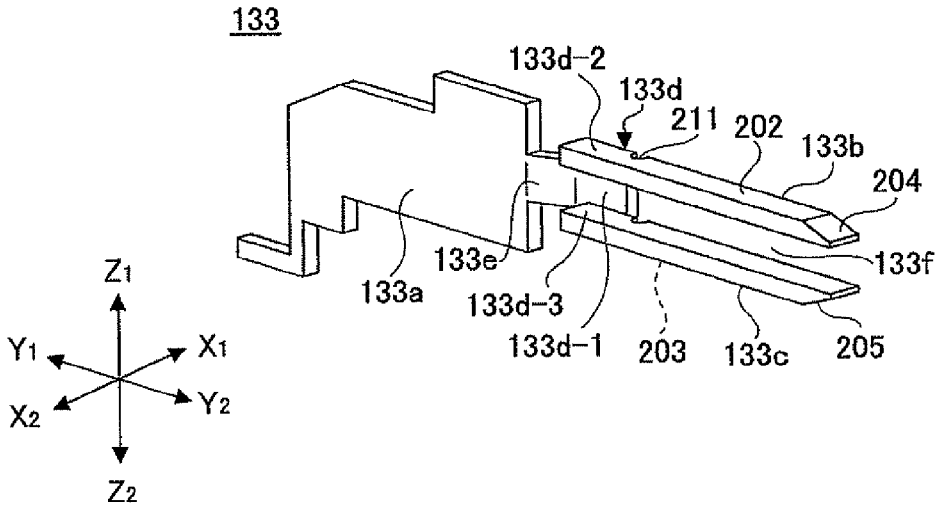

Referring to FIGS. 18A and 18B, the first signal contacts 31, the second signal contacts 32, and the ground contacts 133 are inserted into the electrically insulating block body 140 from the Y1 side so as to be positioned therein. The block body 140 includes a projection part 141 on which the contacts 31, 32, and 133 are exposed and aligned. The projection part 141 includes grooves 142 to which the finger parts 133*b* and 133*c* are fitted. The projection part 141 includes slits 143 into which the base main body parts 206 are fitted. The mechanical strength of the block body 140 is thus higher than that of the conventional block body 40 illustrated in FIG. 3B in which slits 43 extend up to the proximity of the Y2 end of its projection part. Further, each of the finger parts 133*b* and 133*c* is received along its entire length by the corresponding groove 142. Accordingly the finger parts 133*b* and 133*c* are prevented from deflecting even when the finger parts 133*b* and 133*c* are held by the fork parts 23*b* as described below.

In each ground contact 133, the main body part 133*a* and the finger parts 133*b* and 133*c* are positioned so that the center line 270 of the width w of each of the finger parts 133*b* and 133*c* is aligned with (or coincides with) the center line 271 of the thickness t (X1-X2 dimension) of the main body part 133*a*. Accordingly, the ground contacts 133 and the signal contact pairs of the first and second signal contacts 31 and 32 are arranged with the same predetermined pitch p as conventionally.

The socket connector 130 is mounted on a printed board so that each pair of the first and second signal contacts 31 and 32 is connected to a corresponding pair of wiring patterns and the ground contacts 133 are connected to corresponding ground patterns so as to be set to ground potential. Each ground contact 133 has a plate-like shape and provides a shield between the signal contact pair (the first and second signal contacts 31 and 32) on one side of the ground contact 133 and the signal contact pair on the other side of the ground contact 133.

The cable connector 20 is inserted into the socket connector 130 in the Y1 direction so as to be connected thereto as illustrated in FIGS. 10 through 14 and 16. As illustrated in FIGS. 11, 13, 14, and 16, the contact surface 21*c* of the finger part 21*b* of each first signal contact 21 of the cable connector 20 rubs on the upper surface 31*a* of the corresponding first signal contact 31 of the socket connector 130 so as to come into contact therewith, and the contact surface 22*c* of the finger part 22*b* of each second signal contact 22 of the cable connector 20 rubs on the lower surface 32*a* of the corresponding second signal contact 32 of the socket connector 130 so as to come into contact therewith. As illustrated in FIGS. 12 through 14 and 16, the contact surface 23*c* of the fork part 23*b* of each ground contact 23 of the cable connector 20 rubs on the upper surface 202 of the first finger part 133*b* of the corresponding ground contact 133 of the socket connector 130 so as to come into contact therewith, and the contact surface 23*d* of the fork part 23*b* of each ground contact 23 of the cable connector 20 rubs on the lower surface 203 of the second finger part 133*c* of the corresponding ground contact 133 of the socket connector 130 so as to come into contact therewith.

Each first signal contact 21 and the corresponding first signal contact 31 have a "+" signal transmitted thereto. Each second signal contact 22 and the corresponding second signal contact 32 have a "−" signal transmitted thereto.

Each first signal contact 21 and the corresponding signal contact 31 and each second signal contact 22 and the corresponding signal contact 32 are shielded by the corresponding ground contacts 23 and 133 from the adjacent first signal contact 21 and the corresponding signal contact 31 and the adjacent second signal contact 22 and the corresponding signal contact 32 along the X-axis. Further, the signals equal in magnitude and opposite in direction are transmitted to each first signal contact 21 and the corresponding signal contact 31 and each second signal contact 22 and the corresponding signal contact 32. Accordingly, a virtual ground plane is formed between the first signal contacts 21 and 31 and the second signal contacts 22 and 32. As a result, the "+" and "−" signals are transmitted in a state less susceptible to noise in any part of the connected cable connector 20 and socket connector 130.

When the cable connector 20 is pulled in the Y2 direction, each finger part 21*b* rubs on the corresponding first signal contact 31, each finger part 22*b* rubs on the corresponding second signal contact 32, and the contact surfaces 23*c* and 23*d* of each fork part 23*b* rub on the upper surface 202 of the first finger part 133*b* and the lower surface 203 of the second finger part 133*c*, respectively, of the corresponding ground contact 133 so that the cable connector 20 is extracted from the socket connector 130.

The fracture contact surfaces 21*c* and 22*c* of the paired first and second signal contacts 21 and 22 rub on the rolled upper and lower surfaces 31*a* and 32*a* of the corresponding first and second signal contacts 31 and 32, respectively.

The fracture contact surfaces 23*c* and 23*d* of each ground contact 23 rub on the rolled surfaces 202 and 203 of the first and second finger parts 133*b* and 133*c*, respectively, of the corresponding ground contact 133.

Accordingly, with respect to both signal contacts and ground contacts, the occurrence of fracture surfaces rubbing on each other is prevented. This delays the gold-plated layer being scraped off, so that the insertion and extraction durability increases compared with the conventional differential transmission connector unit.

Figure 24A:
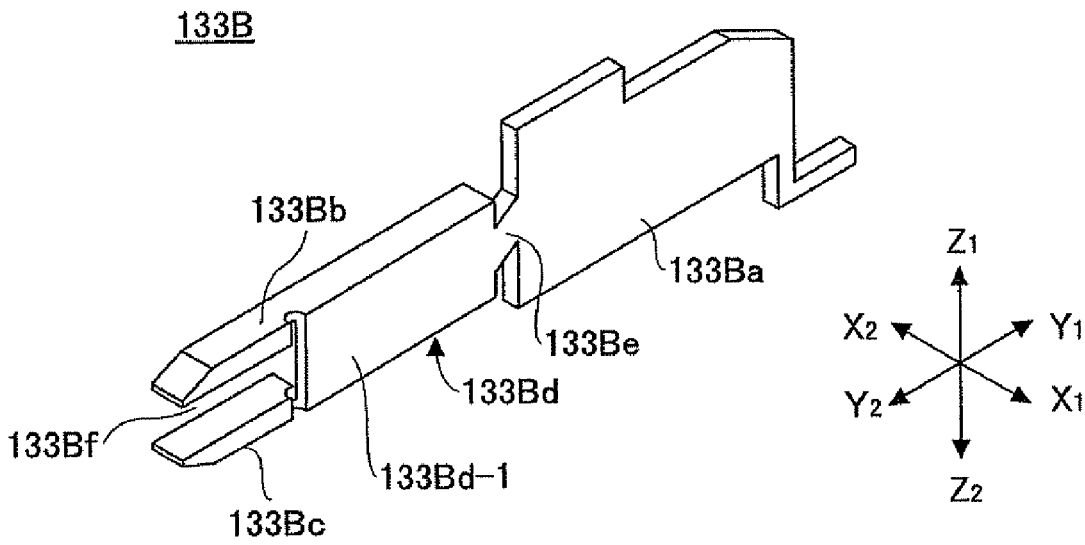
FIGS. 24A and 24B are diagrams illustrating a variation of the ground contact of the socket connector according to the first embodiment of the present invention.
Figure 24B:
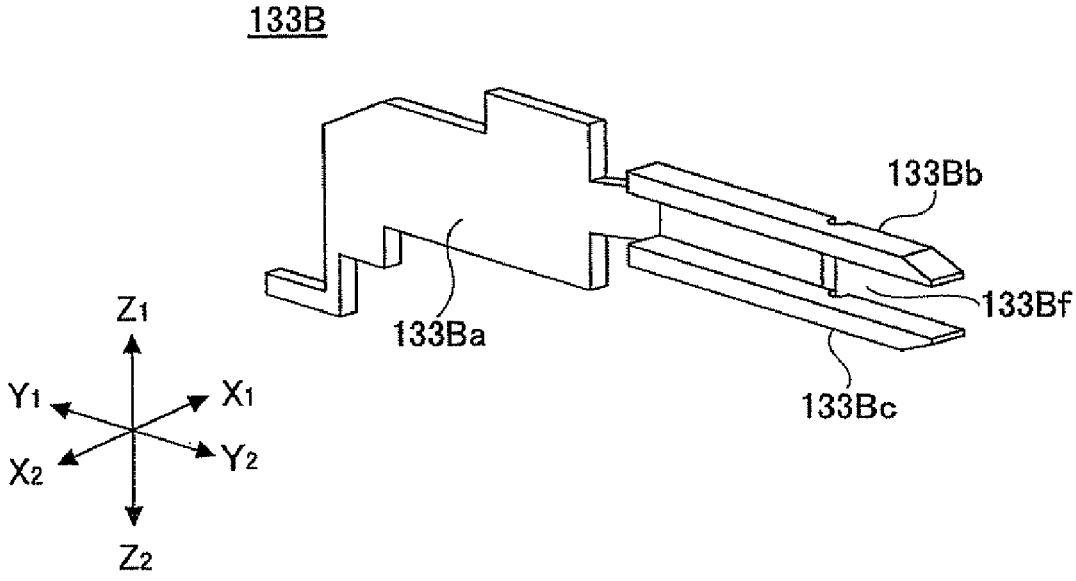

FIGS. 24A and 24B illustrate a ground contact 133B according to a variation of this embodiment. The ground contact 133B includes a plate-like main body part 133Ba, first and second finger parts 133Bb and 133Bc arranged in the Z-axial directions and projecting in the Y2 direction from the main body part 133Ba, a U-shaped base part 133Bd provided at the root (base) of the first and second finger parts 133Bb and 133Bc, and a connection part 133Be connecting the main body part 133Ba and the U-shaped base part 133Bd. The Y1-Y2 dimension of a main body part 133Bd-1 of the U-shaped base part 133Bd is greater (longer) than that of the main body part 133*d*-1 of the U-shaped base part 133*d* of the ground contact illustrated in FIGS. 19A and 19B, and the Y1-Y2 dimension of a space 133Bf between the first and second finger parts 133Bb and 133Bc is less (shorter) than that of the space 133*f* illustrated in FIGS. 19A and 19B. The ground contact 133B has better shielding effect than the ground contact 133 illustrated in FIGS. 19A and 19B.

Second Embodiment

Figure 25A:
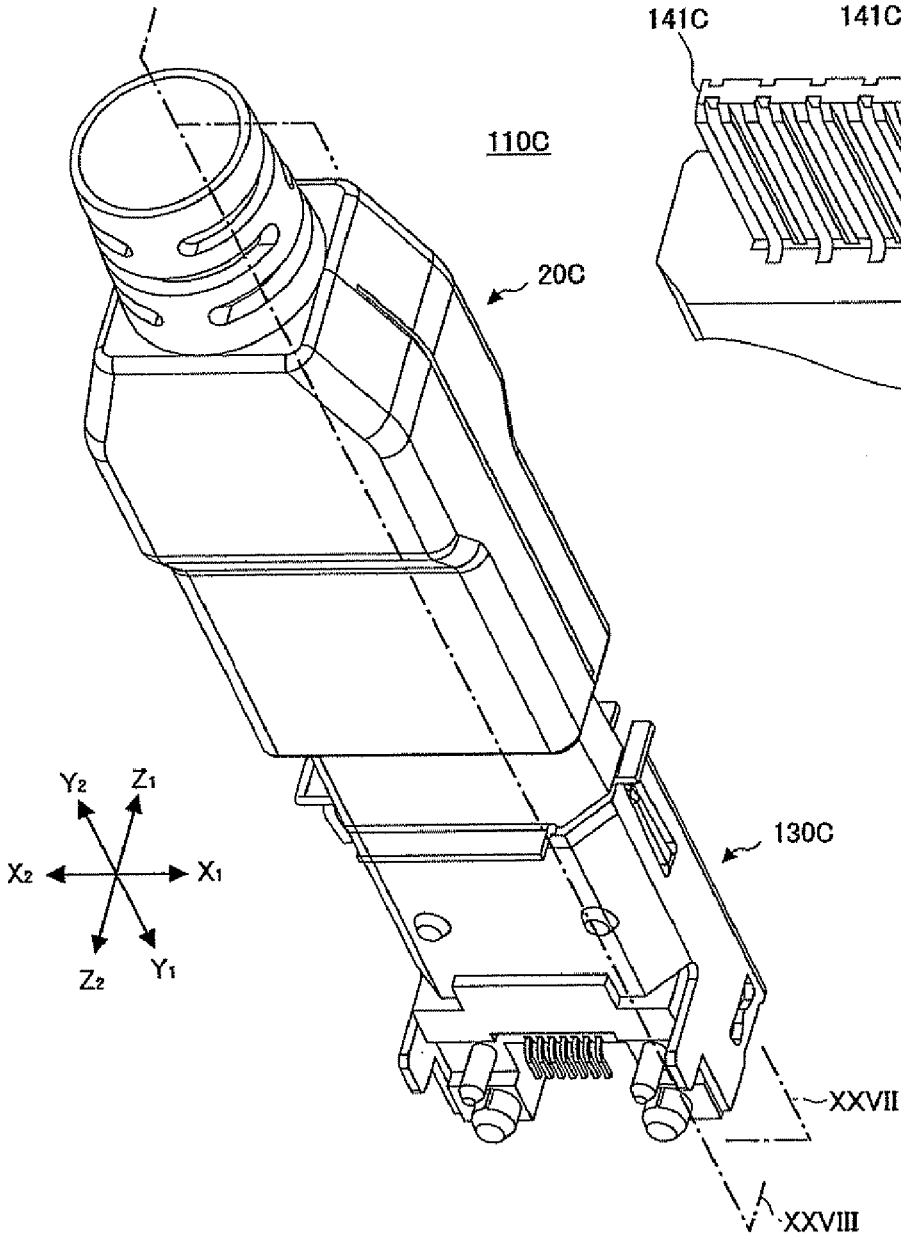
FIG. 25A is a perspective view of a differential transmission connector unit according to a second embodiment of the present invention, in which a cable connector is inserted halfway into a socket connector.
Figure 25B:
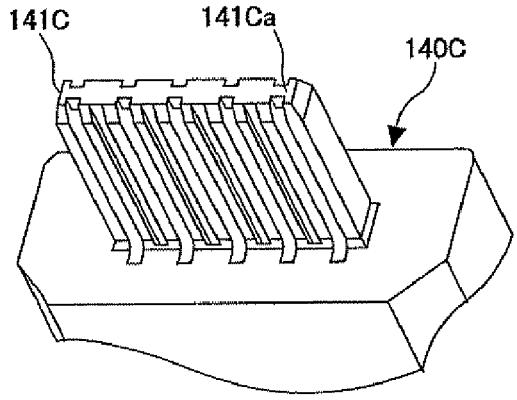
FIG. 25B is a diagram illustrating part of an electrically insulating block body of the socket connector according to the second embodiment of the present invention.
Figure 26A:
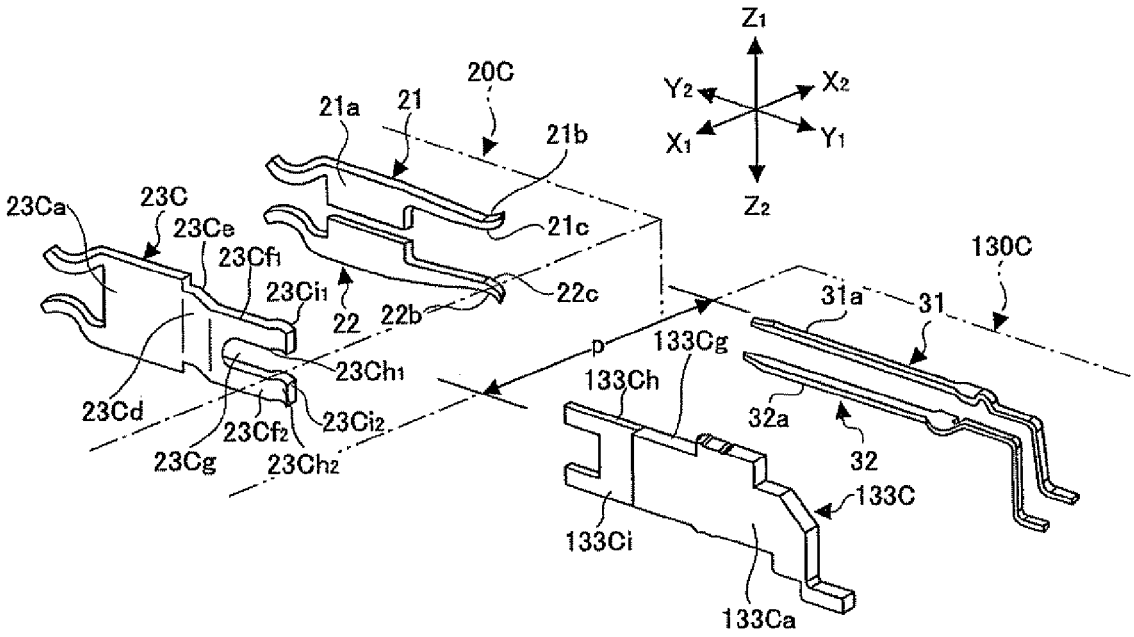
FIG. 26A is a schematic diagram illustrating a state where signal and ground contacts of the cable connector and corresponding signal and ground contacts of the socket connector oppose each other according to the second embodiment of the present invention.
Figure 26B:
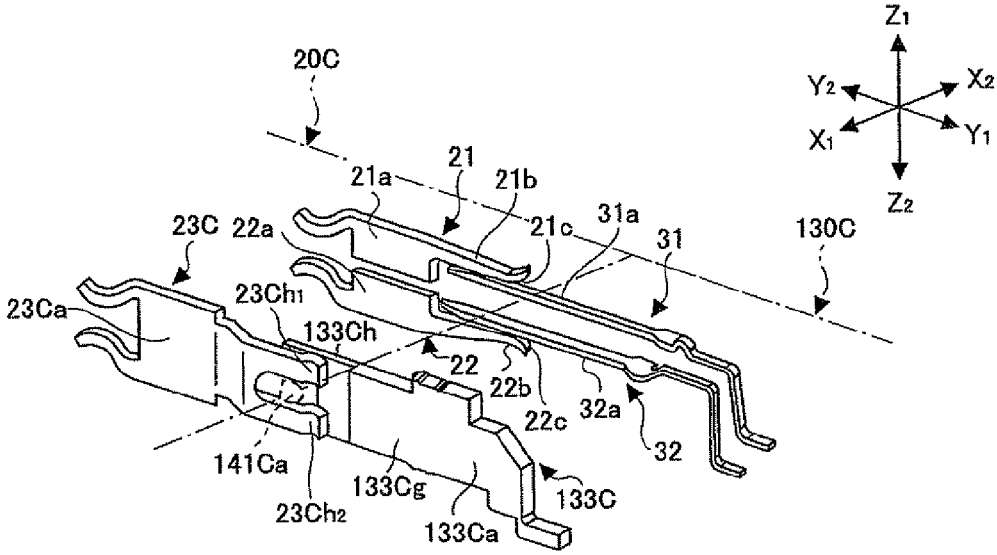
FIG. 26B is a schematic diagram illustrating a state where the cable connector is inserted in and connected to the socket connector so that the contacts of the cable connector are connected to the corresponding contacts of the socket connector according to the second embodiment of the present invention.
Figure 27:
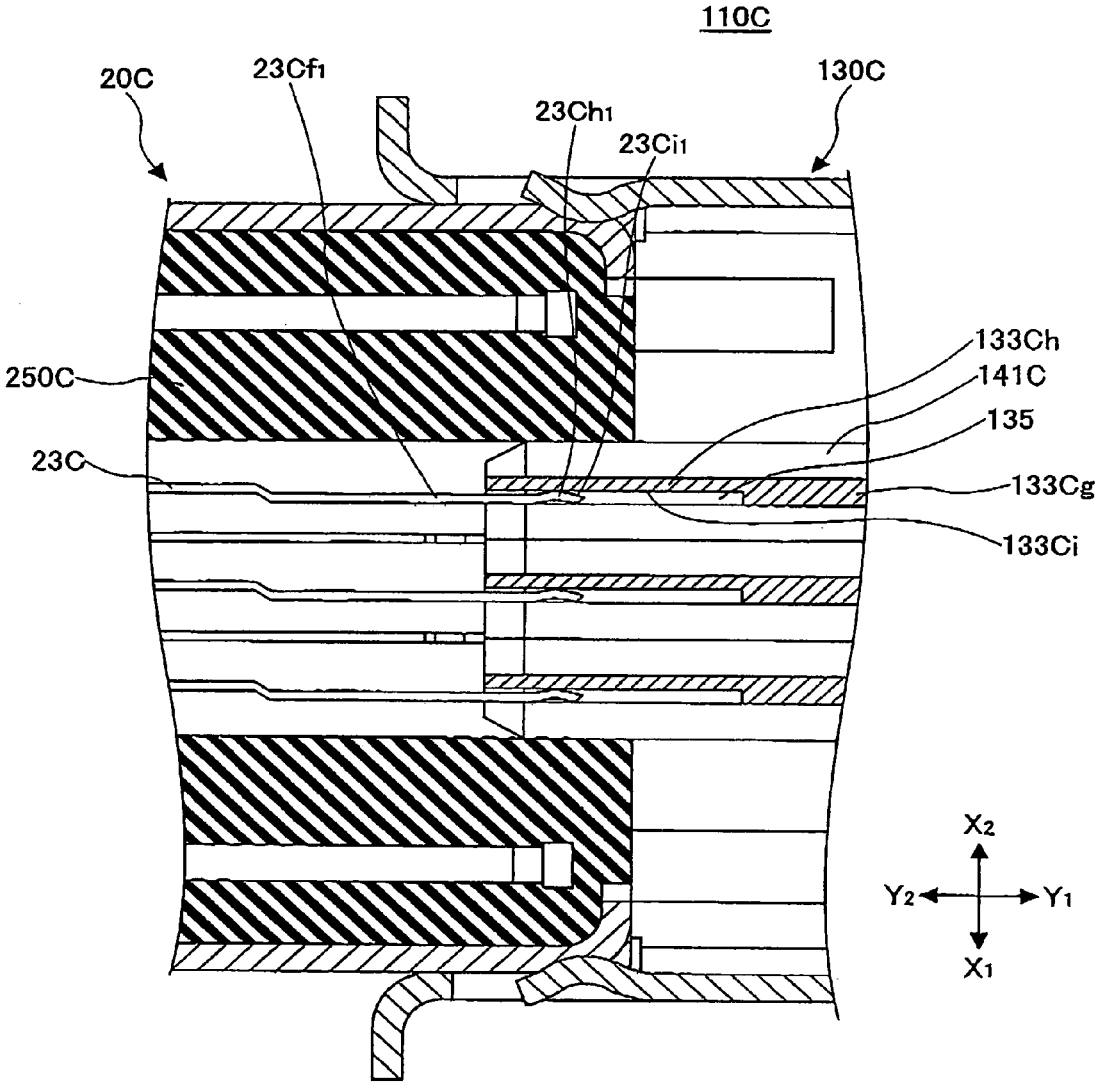
FIG. 27 is a Z1-side sectional view of part of the differential transmission connector unit of FIG. 25A taken along the plane XXVII, illustrating the contact state of the ground contacts, according to the second embodiment of the present invention.
Figure 28:
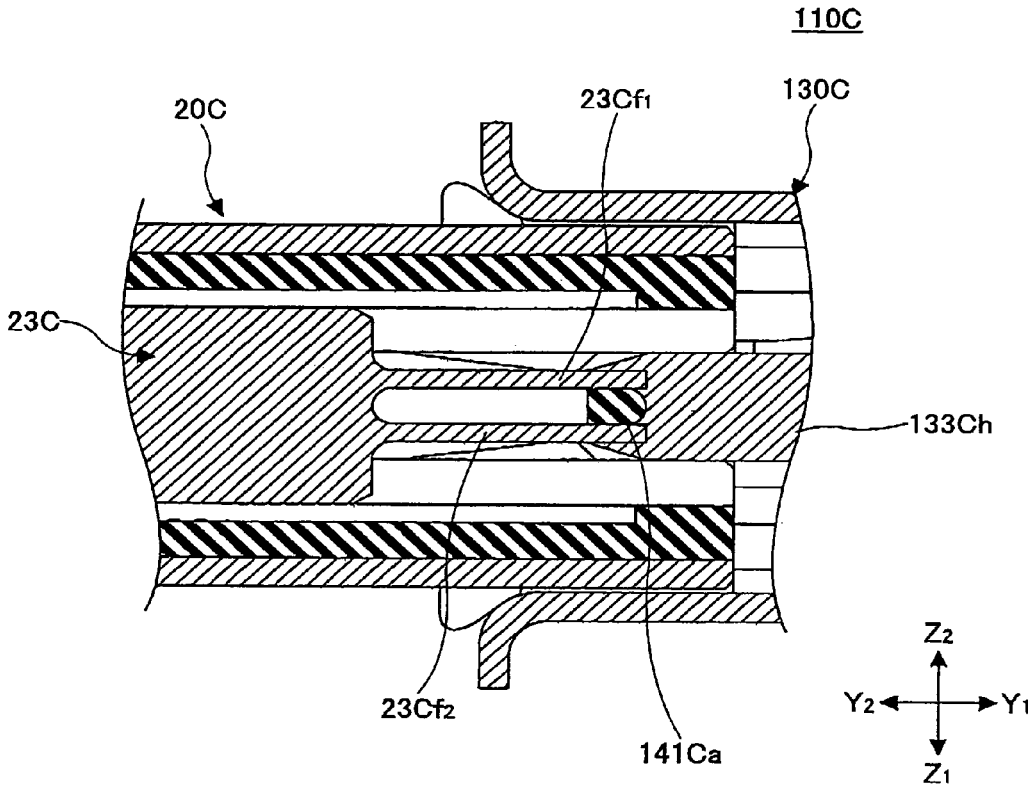
FIG. 28 is an X1-side longitudinal sectional view of the differential transmission connector unit of FIG. 25A taken along the plane XXVIII, illustrating the contact state of the ground contacts, according to the second embodiment of the present invention.
Figure 29A:
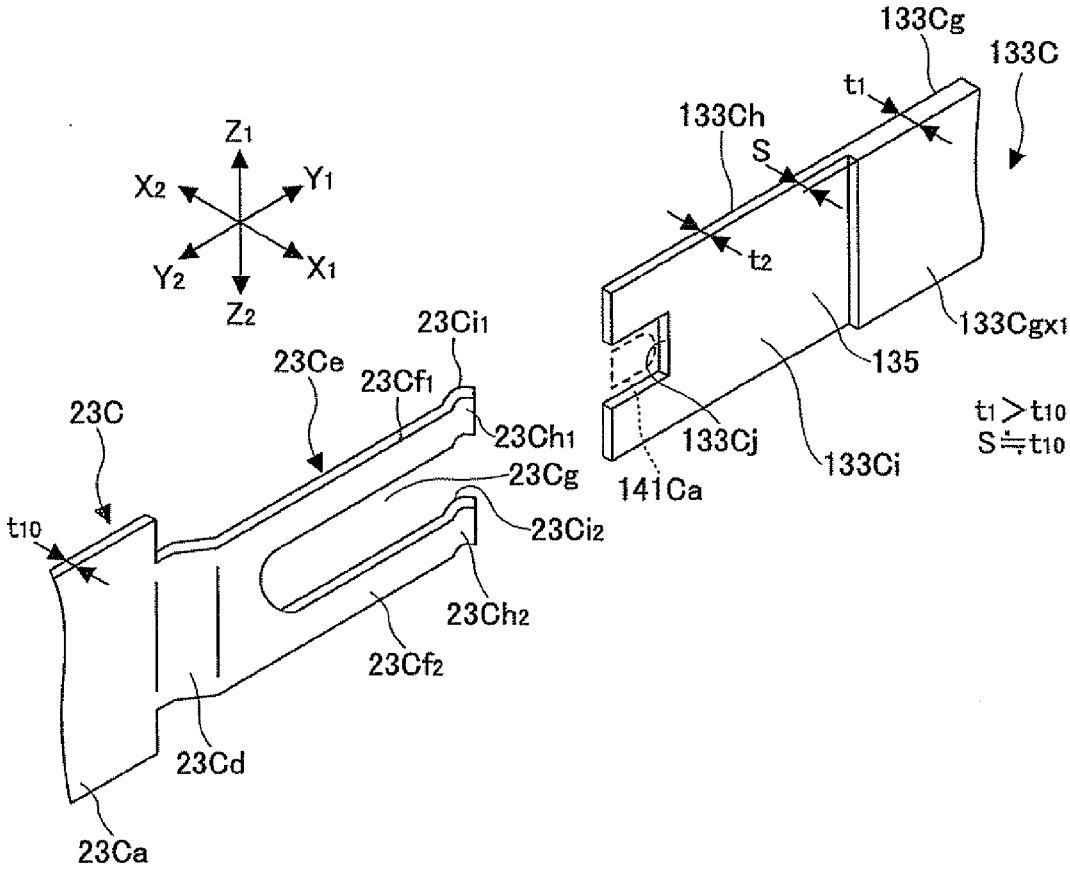
FIGS. 29A and 29B are enlarged views of the ground contacts of the cable connector and the socket connector according to the second embodiment of the present invention.
Figure 29B:
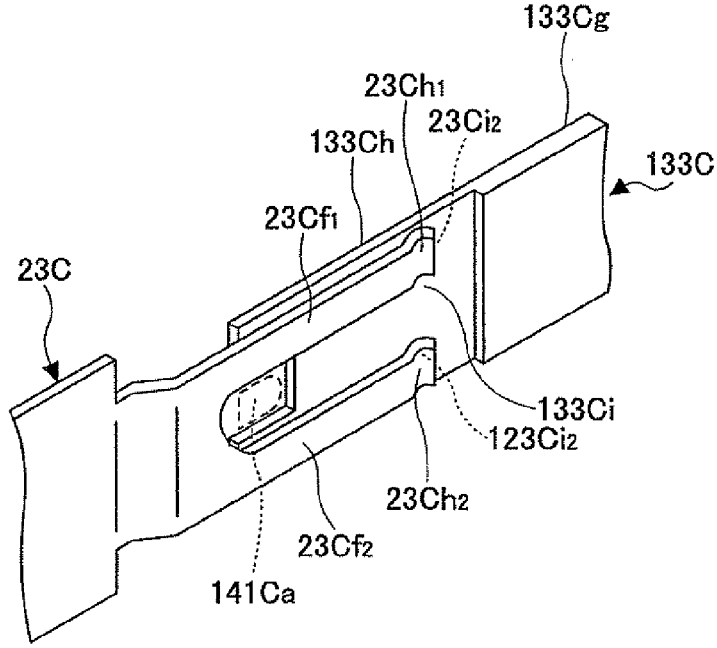

FIG. 25A is a perspective view of a differential transmission connector unit 110C according to a second embodiment of the present invention. The differential transmission connector unit 110C includes a cable connector 200 and a socket connector 130C. FIG. 25A illustrates a state where the cable connector 20C is inserted halfway into the socket connector 130C. FIG. 25B illustrates the Y2 end part of an electrically insulating block body 140C of the socket connector 130C. FIG. 26A is a schematic diagram illustrating a state where a signal contact pair formed of the first and second signal contacts 21 and 22 and a ground contact 23C of the cable connector 20C oppose a corresponding signal contact pair formed of the first and second signal contacts 31 and 32 and a corresponding ground contact 133C, respectively, of the socket connector 130C. FIG. 26B is a schematic diagram illustrating a state where the cable connector 20C is inserted in and connected to the socket connector 130C so that the contacts of the cable connector 20C are connected to the corresponding contacts of the socket connector 130C. FIG. 27 is a Z1-side sectional view of part of the differential transmission connector unit 110C of FIG. 25A taken along the plane XXVII, illustrating the contact state of the ground contacts 23C and 133C. FIG. 28 is an X1-side longitudinal sectional view of the differential transmission connector unit 110C of FIG. 25A taken along the plane XXVIII, illustrating the contact state of the ground contacts 23C and 133C. FIG. 29A is an enlarged view of the Y2 end part of the ground contact 23C and the Y1 end part of the ground contact 133C in a state where the ground contacts 23C and 133C oppose each other. FIG. 29B is an enlarged view of the Y2 end part of the ground contact 23C and the Y1 end part of the ground contact 133C in a state where the ground contacts 23C and 133C are in contact with each other.

The cable connector 20C includes the multiple signal contact pairs of the first and second signal contacts 21 and 22 and the multiple ground contacts 23C incorporated in an electrically insulating block body 250C (FIG. 27), but only some of the contacts 21, 22, and 23C are illustrated in FIGS. 26A and 26B for simplification. Likewise, the socket connector 130C includes the multiple signal contact pairs of the first and second signal contacts 31 and 32 and the multiple ground contacts 133C, but only some of the contacts 31, 32, and 133C are illustrated in FIGS. 26A and 26B for simplification.

The differential transmission connector unit 110C of the second embodiment is different from the differential transmission connector unit 110 illustrated in FIG. 9 of the first embodiment in that the rolled surfaces of each ground contact 23C of the cable connector 20C come into contact with the rolled surfaces of the corresponding ground contact 133C of the socket connector 130C and that their contact is made in the X-axial directions. In FIGS. 25A through 29B, the same elements as those of FIGS. 9 through 13 are referred to by the same numerals, and a description thereof is omitted.

As illustrated in FIGS. 26A, 26B, 29A, and 29B, each ground contact 23C of the cable connector 20C includes a plate part 23Ca, a crank-like bent part 23Cd extending from the Y1 end of the plate part 23Ca with its middle part bent at an angle in the X1 direction, and an extension plate part 23Ce extending from the Y1 end of the bent part 23Cd in the Y1 direction. The extension plate part 23Ce is forked to include a first branch extension plate part 23Cf1 and a second branch extension plate part 23Cf2. A space 23Cg is formed between the first and second branch extension plate parts 23Cf1 and 23Cf2. The Y1 end parts of the first and second branch extension plate parts 23Cf1 and 23Cf2 form contact parts 23Ch1 and 23Ch2, respectively. The X2-side surfaces of the contact parts 23Ch1 and 23Ch2 form contact surfaces 23Ci1 and 23Ci2, respectively. Each ground contact 23C has a thickness t10 (FIG. 29A) of 0.15 mm.

Figure 8:
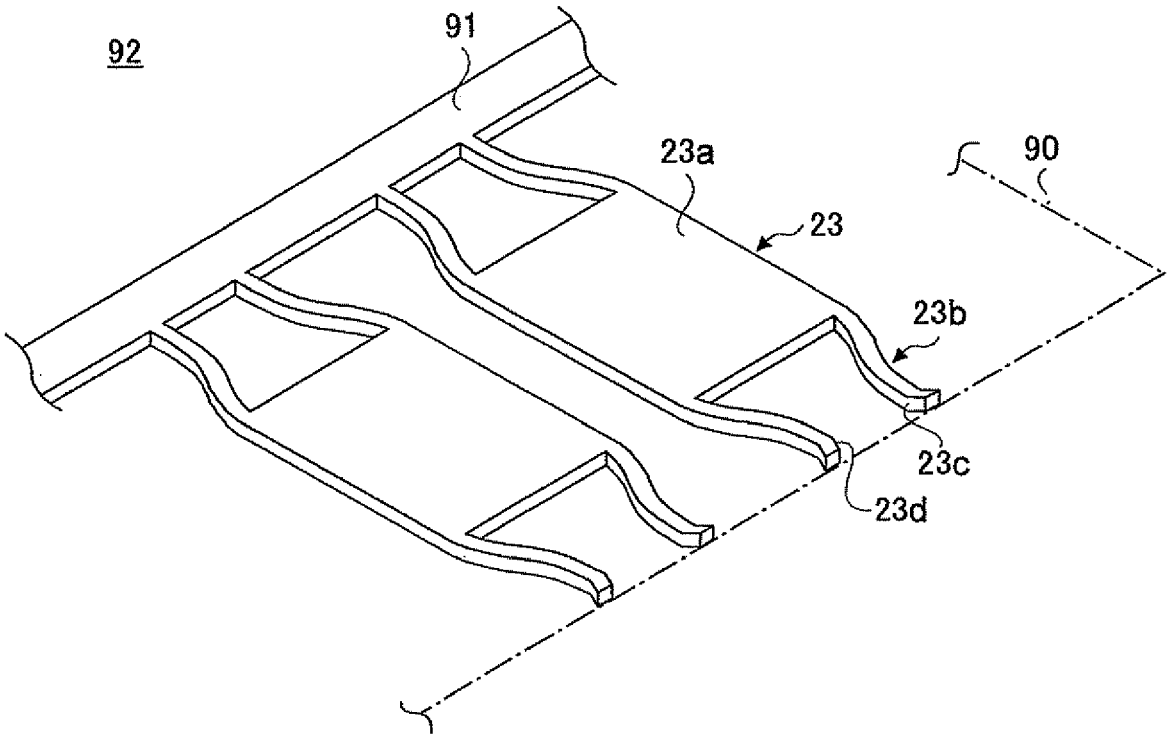
FIG.8 PRIOR ART
FIG. 8 is a diagram for illustrating a process of manufacturing the ground contacts of the conventional cable connector.

The ground contacts 23C are formed in the substantially same manner as illustrated in FIG. 8. That is, a semi-finished product in which the ground contacts 23C are arranged like comb teeth on a belt part is stamped out by press working from a copper-alloy plate material rolled by a roller. Then, the ground contacts 23C are subjected to gold-plating, and cut off from the belt part as finished products. Both contact surfaces 23Ci1 and 23Ci2 are rolled surfaces.

As illustrated also in FIGS. 26A, 26B, 29A, and 29B, each ground contact 133C of the socket connector 130C includes a main body part 133Ca and a narrow rectangular extension plate part 133Cg extending in the Y2 direction from the Y2 end of the main body part 133Ca. The ground contact 133C includes a contact part 133Ch on the Y2 end side of the extension plate part 133Cg. A cutout 133Cj is formed in the Y2 end of the contact part 133Ch. The contact part 133Ch is formed by pressing the Y2 end part of an X1-side surface 133Cgx1 of the extension plate part 133Cg using a press so that the contact part 133Ch is reduced in thickness (X1-X2 dimension) so as to be thin. The X1-side surface of the contact part 133Ch forms a contact surface 133Ci. The contact part 133Ch is formed so that there is a step, or a difference in level, between the contact surface 133Ci and the X1-side surface 133Cgx1 of the extension plate part 133Cg. As a result, a flat space 135 is formed between a surface extending in the Y2 direction from the X1-side surface 133Cgx1 and the contact surface 133Ci as illustrated in FIGS. 27 and 29A. As described below, this space 135 is used to receive the contact parts 23Ch1 and 23Ch2 of the ground contact 23C. The main body part 133Ca and the extension plate part 133Cg have a thickness t1 (FIG. 29A) of 0.4 mm. This thickness t1 may be referred to as the thickness of the ground contact 133C. The contact part 133Ch has a thickness t2 (FIG. 29A) of 0.2 mm. The X1-X2 dimension S of the step is 0.2 mm. The thickness t1 is approximately twice the thickness t10 of the ground contact 23C. The X1-X2 dimension S of the step is substantially equal to the thickness t10.

The ground contacts 133C are formed as follows. A semi-finished product in which the ground contacts 133C are arranged like comb teeth on a belt part is stamped out by press working from a copper-alloy plate material rolled by a roller with part of the semi-finished product being pressed using a press. Then, the ground contacts 133C are subjected to gold-plating, and cut off from the belt part as finished products. The contact surface 133Ci of each ground contact 133C is pressed using a press but remains a rolled surface.

As illustrated in FIG. 25B, the electrically insulating block body 140C of the socket connector 130C includes a bridge part 141Ca in the Y2 end part of a projection part 141C thereof. The bridge part 141Ca passes through the cutout 133Cj of each ground contact 133C along the X-axis, thereby reinforcing mechanical strength.

When the cable connector 20C is connected to the socket connector 130C, each ground contact 23C comes into contact with the corresponding ground contact 133C as illustrated in FIGS. 26B, 27, 28, and 29B. That is, the contact parts 23Ch1 and 23Ch2 at the Y1 ends of the first and second branch extension plate parts 23Cf1 and 23Cf2 pass the Z1 and Z2 sides, respectively, of the bridge part 141Ca to reach the X1 side of the contact part 133Ch and enter the space 135. Then, the contact surfaces 23Ci1 and 23Ci2 of the contact parts 23Ch1 and 23Ch2 rub and move on the contact surface 133Ci of the contact part 133Ch so as to come into contact therewith. The contact parts 23Ch1 and 23Ch2 and the contact part 133Ch are in contact with each other in the X-axial directions. When the cable connector 20C is pulled in the Y2 direction so as to be disconnected from the socket connector 130C, the contact surfaces 23Ci1 and 23Ci2 of the contact parts 23Ch1 and 23Ch2 also rub and move on the contact surface 133Ci of the contact part 133Ch.

The contact surfaces 23Ci1 and 23Ci2 and the contact surface 133Ci rubbing on each other are all rolled surfaces. This delays the gold-plated layer being scraped off, so that the insertion and extraction durability increases compared with the conventional differential transmission connector unit. The insertion and extraction durability also increases compared with the differential transmission connector unit 110 of the first embodiment.

As illustrated in FIG. 27, the contact part 133Ch of the ground contact 133C is formed to provide a step relative to the X1-side surface 133Cgx1 of the extension plate part 133Cg, so that the contact parts 23Ch1 and 23Ch2 of the ground contact 23C are contained in the flat space 135. As a result, the X1-X2 dimension of the part where the contact parts 23Ch1 and 23Ch2 and the contact part 133Ch are in contact with each other is prevented from increasing. This allows the contacting signal contacts 21, 22, 31, and 32 and the contacting ground contacts 23C and 133C to be arranged with the narrow pitch p (FIG. 26A).

Further, the ground contact 23C includes the bent part 23Cd. Accordingly, as illustrated in FIG. 27, with the ground contacts 23C and 133C being in contact with each other, the ground contacts 23C and 133C are aligned in the Y-axial directions, and the ground contact 23C substantially falls within the range of thickness (t1) of the ground contact 133C in the Y2 direction therefrom, thus preventing an increase in size.

Third Embodiment

Figure 30:
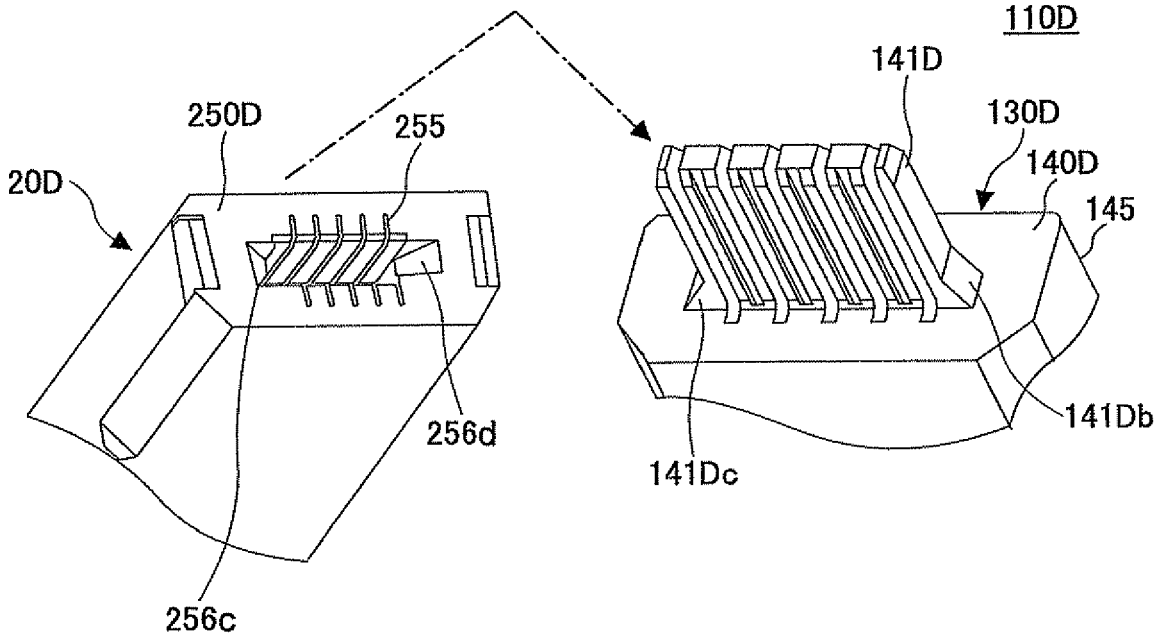
FIG. 30 is a schematic diagram illustrating a cable connector and a socket connector forming a differential transmission connector unit according to a third embodiment of the present invention.
Figure 31A:
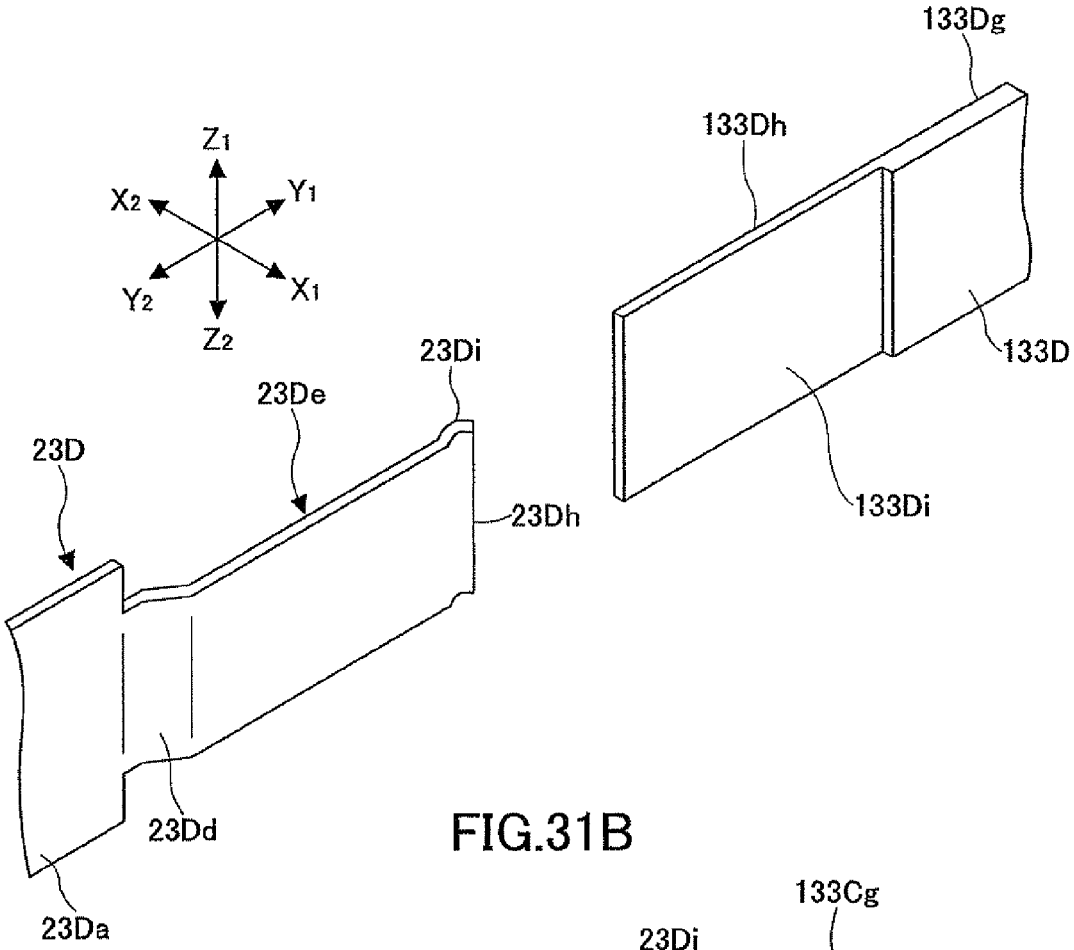
FIGS. 31A and 31B are enlarged views of ground contacts of the cable connector and the socket connector according to the third embodiment of the present invention.

FIG. 30 is a schematic diagram illustrating a differential transmission connector unit 110D according to a third embodiment of the present invention. The differential transmission connector unit 110D includes a cable connector 20D and a socket connector 130D. FIG. 31A illustrates a state where one of ground contacts 23D incorporated in the cable connector 20D opposes a corresponding one of ground contacts 133D incorporated in the socket connector 130D. The ground contacts 23C and 133C are partially modified into the ground contacts 23D and 133D, respectively.

As illustrated in FIG. 31A, the ground contact 23D includes a plate part 23Da, a bent part 23Dd, and an extension plate part 23De. Unlike the extension plate part 23Ce of the ground contact 23C of the second embodiment, the extension plate part 23De is not forked. The ground contact 23D includes a contact part 23Dh at the Y1 end of the extension plate part 23De, and a contact surface 23Di on the X2 side of the contact part 23Dh.

As also illustrated in FIG. 31A, the ground contact 133D is equal in shape to the ground contact 133C without the cutout 133Cj. The ground contact 133D includes an extension plate part 133Dg extending in the Y2 direction from a main body part (not graphically illustrated), and a contact part 133Dh on the Y2 end side of the extension plate part 133Dg. The ground contact 133D further includes a contact surface 133Di on the X1 side of the contact part 133Dh.

Figure 31B:
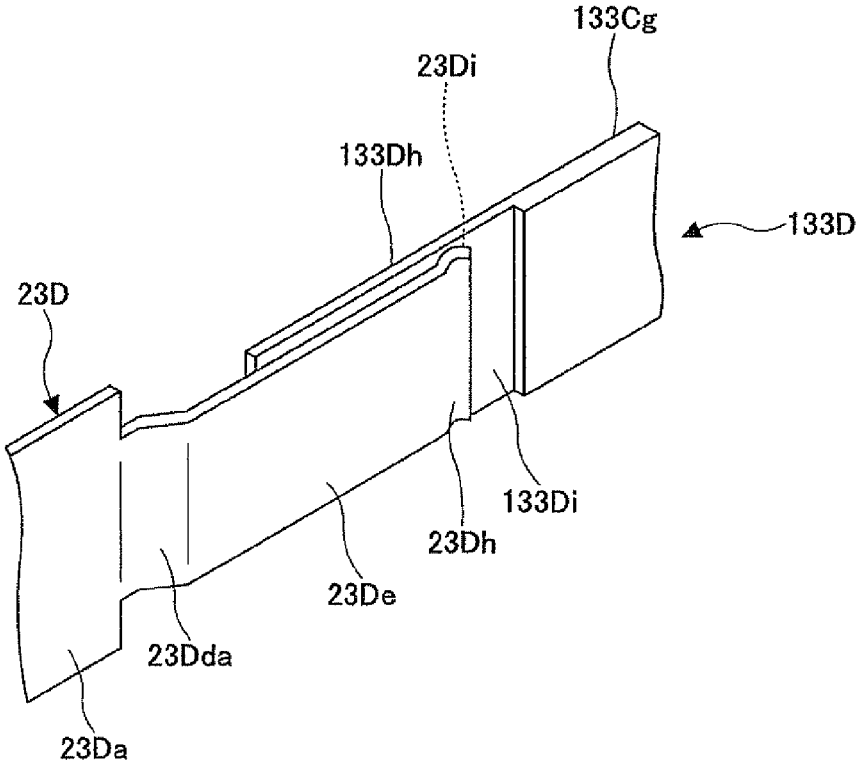

When the cable connector 20D is connected to the socket connector 130D, the ground contact 23D comes into contact with the ground contact 133D as illustrated in FIG. 31B. That is, the contact surface 23Di of the contact part 23Dh rubs and moves on the contact surface 133Di of the contact part 133Dh so as to come into contact therewith. The contact surfaces 23Di and 133Di rubbing on each other are both rolled surfaces. This delays the gold-plated layer being scraped off, so that the insertion and extraction durability increases compared with the conventional differential transmission connector unit.

Since the ground contact 133D does not have the cutout 133Cj, the bridge part 141Ca illustrated in FIG. 25B cannot be formed in a projection part 141D of an electrically insulating block body 140D (FIG. 30) of the socket connector 130D. The lack of the bridge part 141Ca reduces beam part strength at both side ends of the projection part 141D. In order to compensate for this reduction in beam part strength, in the block body 140D, fillet parts 141Db and 141Dc are formed at the root (base) part of the projection part 141D connecting the projection part 141D to a main body part 145 of the block body 140D as illustrated in FIG. 30.

As also illustrated in FIG. 30, in an electrically insulating block body 250D of the cable connector 20D, chamfered recesses 256*c* and 256*d* corresponding to the fillet parts 141Db and 141Dc are formed in an inlet 255 of a space into which the projection part are fitted.

The fillet parts 141Db and 141Dc fit in the chamfered recesses 256*c* and 256*d*, respectively, with the cable connector 20D being connected to the socket connector 130D.

The present invention is not limited to the specifically disclosed embodiments, and variations and modifications may be made without departing from the scope of the present invention.

What is claimed is:

1. A differential transmission connector unit, comprising:

a first differential transmission connector including a first electrically insulating block body, and a plurality of first signal contact pairs and at least one first ground contact arranged alternately in a row in the first electrically insulating block body; and a second differential transmission connector including a second electrically insulating block body, and a plurality of second signal contact pairs and at least one second ground contact arranged alternately in a row in the second electrically insulating block body, wherein the first differential transmission connector is connected to the second differential transmission connector with the first signal contact pairs and the second signal contact pairs being in contact with each other and the at least one first ground contact and the at least one second ground contact being in contact with each other, the first ground contact includes a first plate-like extension plate part and a first contact part at an end of the first extension plate part, the first contact part including a first contact surface, the second ground contact includes a second plate-like extension plate part and a second contact part at an end of the second extension plate part, the second contact part including a second contact surface, the first contact part of the first ground contact is formed with a step such that a terminal part of the first contact part is thinner than a part proximate to the first extension plate part to thereby form a space extending from the first extension plate part on a surface of the thinner terminal part, the surface of the thinner terminal part being the first contact surface, and the second contact part of the second ground contact is contained in the space, with the first contact surface of the first contact part and the second contact surface of the second contact part being in contact with each other.

2. The differential transmission connector unit as claimed in claim 1, wherein:

the first extension plate part and the second extension plate part are positioned side by side in a row direction in which the first and second ground contacts are arranged so that the first contact surface of the first contact part and the second contact surface of the second contact part are in contact with each other in the row direction with the first and second differential transmission connectors being connected to each other.

3. The differential transmission connector unit as claimed in claim 2, wherein:

the first ground contact is greater in thickness than the second ground contact.

4. The differential transmission connector unit as claimed in claim 3, wherein:

the second ground contact includes a crank-like bent part in the second extension plate part; and the second ground contact falls within a range of thickness of the first ground contact in a direction extending therefrom to the second ground contact, with the first contact surface of the first contact part and the second contact surface of the second contact part being in contact with each other in the row direction.

5. The differential transmission connector unit as claimed in claim 2, wherein:

the first ground contact includes a cutout in an end part of the first plate-like extension plate part;

the first electrically insulating block body includes a projection part in which the first extension plate part is contained, and a bridge part at an end of the projection part, the bridge part passing through the cutout in the row direction;

the second extension plate part of the second ground contact is forked, including first and second branch extension plate parts; and the first and second branch extension plate parts are disposed on both sides of the bridge part, with the first contact part of the first ground contact and the second contact part of the second ground contact being in contact with each other in the row direction.

6. The differential transmission connector unit as claimed in claim 2, wherein:

the first electrically insulating block body includes a main body part, a projection part projecting from the main body part and containing the first extension plate part, and a fillet part for reinforcement, the fillet part being provided to a base part of the projection part, the base part connecting the projection part to the main body part;

the second electrically insulating block body includes a chamfered recess corresponding to the fillet part, the chamfered recess being provided to an inlet part of a recess in which the projection part is fitted; and the fillet part fits in the chamfered recess with the first and second differential transmission connectors being connected to each other.

* * * * *